US007608377B2

(12) United States Patent
Nakayama et al.

(10) Patent No.: US 7,608,377 B2
(45) Date of Patent: Oct. 27, 2009

(54) IMAGE FORMING METHOD AND IMAGE FORMING APPARATUS

(75) Inventors: Shinya Nakayama, Numazu (JP); Hisashi Nakajima, Numazu (JP); Hideki Sugiura, Fuji (JP); Fumihiro Sasaki, Fuji (JP); Akihiro Kotsugai, Numazu (JP); Satoshi Mochizuki, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 308 days.

(21) Appl. No.: 11/519,057

(22) Filed: Sep. 12, 2006

(65) Prior Publication Data

US 2007/0059063 A1 Mar. 15, 2007

(30) Foreign Application Priority Data

Sep. 13, 2005 (JP) ..... 2005-264818
Jul. 31, 2006 (JP) ..... 2006-207478

(51) Int. Cl.
*G03G 13/20* (2006.01)

(52) U.S. Cl. ..... 430/124.31; 430/108.6; 430/108.11

(58) Field of Classification Search ..... 430/108.6, 430/108.7, 108.1, 124.31
See application file for complete search history.

(56) References Cited

U.S. PATENT DOCUMENTS 6,200,722 B1 * 3/2001 Fields et al. ..... 430/137.21
6,934,484 B2 8/2005 Suzuki et al.
2004/0067189 A1 4/2004 Sugiura et al.
2004/0072091 A1 4/2004 Mochizuki et al.
2004/0115550 A1 6/2004 Sugiura et al.
2004/0131961 A1 * 7/2004 Watanabe et al. ..... 430/108.4
2004/0229143 A1 11/2004 Umemura et al.
2005/0026064 A1 2/2005 Sugiura et al.
2005/0089786 A1 4/2005 Sugiura et al.
2005/0089787 A1 4/2005 Uchinokura et al.
2005/0208408 A1 9/2005 Uchinokura et al.
2005/0208411 A1 * 9/2005 Nakayama et al. ..... 430/109.4
2006/0029433 A1 2/2006 Saito et al.

(Continued)

FOREIGN PATENT DOCUMENTS

JP 63-313182 12/1988

(Continued)

OTHER PUBLICATIONS

U.S. Appl. No. 12/048,741, filed Mar. 14, 2008, Moriya, et al.

(Continued)

*Primary Examiner*—John L Goodrow
(74) *Attorney, Agent, or Firm*—Oblon, Spivak, McClelland, Maier & Neustadt, L.L.P.

(57) ABSTRACT

To provide an image forming method including forming a latent electrostatic image on a latent electrostatic image bearing member, developing the latent electrostatic image using a toner to form a visible image, transferring the visible image to a recording medium, and fixing a transfer image transferred on the recording medium, wherein the toner includes a toner base particle containing at least a binder resin, a colorant and an inorganic fine particle, and a charge control agent; and wherein the condition $X_{surf}>X_{total}$ is satisfied (where $X_{surf}$ is an average proportion of the inorganic fine particles in a near-surface region of the toner base particle, $X_{total}$ is an average proportion of inorganic fine particles in the whole toner base particle.

15 Claims, 8 Drawing Sheets

U.S. PATENT DOCUMENTS

| | | | |
|---|---|---|---|
| 2006/0063081 | A1 | 3/2006 | Nagatomo et al. |
| 2006/0068313 | A1 | 3/2006 | Nakayama et al. |

FOREIGN PATENT DOCUMENTS

| | | |
|---|---|---|
| JP | 1-263679 | 10/1989 |
| JP | 8-22206 | 1/1996 |
| JP | 8-44111 | 2/1996 |
| JP | 2000-122347 | 4/2000 |
| JP | 2004-53916 | 2/2004 |
| JP | 2004-177555 | 6/2004 |
| JP | 2005-49853 | 2/2005 |
| JP | 2005-49858 | 2/2005 |
| JP | 2006-47743 | 2/2006 |
| JP | 2006-220673 | 8/2006 |
| WO | WO 2004/086149 A1 | 10/2004 |

OTHER PUBLICATIONS

U.S. Appl. No. 12/048,823, filed Mar. 14, 2008, Honda, et al.
U.S. Appl. No. 12/049,686, filed Mar. 17, 2008, Kotsugai, et al.
U.S. Appl. No. 12/050,502, filed Mar. 18, 2008, Yamada, et al.
U.S. Appl. No. 12/047,807, filed Mar. 13, 2008, Honda, et al.

* cited by examiner

IMAGE FORMING METHOD AND IMAGE FORMING APPARATUS

BACKGROUND OF THE INVENTION

1. Field of the Invention

The present invention relates to an image forming method and an electrophotographic image forming apparatus such as printers, reproduction devices, and facsimiles.

2. Description of the Related Art

Recently, with respect to image forming apparatuses such as printers, copiers, and facsimiles, the market demand of energy saving and speeding up is growing stronger. To obtain these performances, it is important to achieve improvement in heat efficiency of a fixing unit for use in an image forming apparatus.

In an image forming apparatus, by image forming processes such as electrophotographic recording, electrostatic recording, or magnetic recording, a toner image not having been fixed is formed on a recording medium such as recording sheets, printing papers, photosensitive papers, electrostatic recording papers by an image transfer method or a direct method. In fixing units for fixing such a toner image not having been fixed, contact heating systems such as heating roller system, film heating system, and electromagnetic induction heating system are widely employed.

The fixing unit of heating roller system has the basic construction of a pair of rotating rollers of a fixing roller that includes a heat source such as halogen lamp to be adjusted at a predetermined temperature, and a pressure roller that is pressed in contact with this fixing roller. A recording medium is inserted into the contact portion (the so-called nip portion) between a pair of these rollers, and delivered. Thus, a toner image not having been fixed is melted and fixed due to heat and pressure provided from the fixing roller and the pressure roller.

The fixing units of film heating system are proposed in, for example, Japanese Patent Application Laid-Open (JP-A) No. 63-313182, and Japanese Patent Application Laid-Open (JP-A) No. 01-263679.

In such fixing units of film heating system, a recording medium is brought in close contact with a heating element that is fixed and supported by a support member via a thin fixing film having a heat resistance, and heat of the heating element is applied to the recording medium via the film member while the fixing film is made to slide and move with respect to the heating element.

As the heating element, for example, used is a ceramic heater in which there is provided a resistance layer on a ceramic substrate such as alumina or aluminum nitride having properties of heat resistance, insulating property, and high heat conductivity.

In this fixing unit, a thin fixing film of low heat capacity can be used, so that a higher efficiency of heat transfer is achieved than the heating roller system, and a shorter warm-up time period is achieved. Thus, more quick start or energy saving comes to be possible.

As the fixing units of electromagnetic induction heating system, proposed is art in which, for example, Joule heat is generated by an eddy current generated at a magnetic metal member with an AC magnetic field, and a heating element including a metal member is made to generate heat by electromagnetic induction (see Japanese Patent Application Laid-Open (JP-A) No. 08-22206).

The configuration of the fixing unit of electromagnetic induction system will be described. FIG. 1 is a schematic view showing a conventional fixing unit of an electromagnetic induction heating system. This fixing unit is constructed of a film inner surface guide 121 on which mounted is a heating element 120 formed of an exciting coil unit 118 and a magnetic metal member 119, being a heating part; a cylindrical film 117 having a heat resistance that contains therein the film inner-surface guide 121 in the state in which the magnetic metal member 119 is in contact with the inner wall; and a pressure roller 122 that is pressed against the film 117 in a position of the magnetic metal member 119 to form a nip portion N with this film 117, as well as that causes this film 117 to rotate.

As the film 117, used is a single-layer film such as PTFE, PFA, or FEP whose thickness is 100 μm or less, and which has a heat resistance, or a composite-layer film in which coating of e.g., PTFE, PFA, and FEP is made on the perimeter surface of e.g., polyimide, polyamideimide, PEEK, PES and PPS.

The film inner-surface guide 121 is formed of materials having rigidity and heat resistance that are made of resin such as PEEK or PPS. The heating element 120 is fitted substantially at the central portion in a longitudinal direction of such a film inner-surface guide 121.

The pressure roller 122 is formed of a core 122*a*, and a heat resistant rubber layer 122*b* having a superior releasing property such as silicone rubber that is located around the core 122*a*. This pressure roller 122 is located so as to be pressed in contact with the magnetic metal member 119 of the heating element 120 with the film 117 sandwiched under a predetermined compressive force provided by bearings or biasing unit (either one is not shown). Further, the pressure roller 122 is driven to rotate in a counterclockwise direction by driving unit (not shown).

Due to that the pressure roller 122 is driven to rotate, a friction is generated between the pressure roller 122 and the film 117, the rotary force acts on the film 117, and the film 117 is slidingly rotated while being in contact with the magnetic metal member 119 of the heating element 120.

In the state in which the heating element 120 has reached a predetermined temperature, a recording medium 111 including a toner image T not having been fixed that is formed at the image-forming section (not shown) is inserted into the nip portion N between the film 117 and the pressure roller 122. Owing to that this recording medium 111 is delivered at the nip portion N with sandwiched between the pressure roller 122 and the film 117, heat of the magnetic metal member 119 is applied to the recording medium 111 via the film 117, and a toner image T not having been fixed is melted and fixed on the recording medium 111. Moreover, at the outlet of the nip portion N, the recording medium 111 having been passed is separated from the surface of the film 117 to be delivered to a paper ejection tray (not shown).

In such a fixing unit of electromagnetic induction heating system, owing to the use of generation of an eddy current, the magnetic metal member 119 acting as induction heating unit can be located in the vicinity of a toner image T of the recording medium 111 via the film 117, resulting in further improved heating efficiency as compared with the foregoing fixing unit of film heating system.

However, fixing units in a full-color image forming apparatus need to be capable of sufficiently heating and melting a thick toner particle layer, being a laminate of four layers or more. To meet this need, in the fixing units of electromagnetic induction heating system, a rubber elastic layer of a certain thickness is required at the film surface to fully cover and uniformly heat and melt a toner image. In the case where the film surface is covered with an elastic layer such as silicone rubber to a certain extent, a thermal responsiveness becomes worse due to a low heat conductivity of the elastic layer, and thus there will be a significantly large temperature difference between the inner surface of a film heated from a heating element, and the film outer surface in contact with toner. In the case of a large amount of toner, the belt surface temperature is rapidly decreased, and a sufficient fixing performance cannot be achieved, and thus a problem exists in that the so-called cold offset occurs.

Meanwhile, in the image forming method, a latent electric image or a latent magnetic image is developed with toner. For example, in the electro-photographic image forming method, an electrostatic image (latent image) is formed on a photoconductor (hereinafter, may be referred to as "latent electrostatic image bearing member", "image bearing member", or "electrophotographic photoconductor"), this latent is developed using toner, and a toner image is formed. Subsequently, a toner image is normally transferred onto a recording medium such as paper, and fixed.

Toner for use in development is generally a colored particle in which a binder resin is included with a colorant, a charge control agent, and other additives therein. Manufacturing methods thereof are roughly divided into pulverization and suspension polymerization. In the pulverization, a colorant, a charge control agent, an anti-offset agent and the like are melted and mixed in a thermoplastic resin to be uniformly dispersed, and a toner composition having been obtained is pulverized and classified, whereby toner is manufactured. By this pulverization method, toner having a superior property to some extent can be manufactured, but selection of toner materials is limited. For example, a toner composition obtained by being melted and mixed has to be pulverized and classified using an apparatus to be economically usable. With this need, a toner composition melted and mixed cannot help being sufficiently fragile.

Therefore, practically, when the toner composition is pulverized into particles, it is likely that the particle size distribution thereof will be broad. Further, to obtain a copy image having high resolution and many levels of gray, fine powders of a particle size of 5 μm or less and coarse grains of a particle size of 20 μm or more have to be removed by classification, resulting in the disadvantage of extremely lower yield. Furthermore, in the milling, additives such as colorant and charge control agent are hard to be uniformly dispersed in a thermoplastic resin. Such a non-uniform dispersion of additives adversely affects a flow property, developability, durability, an image quality and the like. In addition, a problem exits in that there is restriction on particle sizes by the pulverization method, and still smaller particles cannot be obtained.

Recently, the need of higher image quality is increased. In particular, to actualize formation of a color image of high resolution, smaller particle size and more spherical shape are required to achieve. With smaller particle size, it is possible to have higher reproducibility of dots. With more spherical shape, it is possible to achieve improvement in development and transfer properties. Furthermore, in recent days, a cleaning-less system has become widely used in which higher transfer efficiency is achieved using toners with more spherical shape.

For example, in Japanese Patent Application Laid-Open (JP-A) No. 2004-177555, a cleaning-less image forming apparatus in which with the use of a spherical toner having at least one of a charge control agent and an organic fine particle present on the surface, higher transfer efficiency is achieved, and thus a residual transfer toner is reduced. In such an image forming apparatus, out of residual transfer toners, only inversely charged toner is collected with a brush roller, emitted to a photoconductor drum at a predetermined timing, and transferred to an intermediate transfer belt. Then, when this inversely charged toner passes through the charged region, charge bias is stopped, or a charging roller is spaced apart from the photoconductor drum, thereby preventing charge defects of an image bearing member due to that the residual transfer toners are adhered to a charging member.

However, as toner has a smaller particle size, transfer efficiency decreases. This is due to the fact that a non-electrostatic adhesion force such as van der Waals force acting between toner and a photoconductor increases with increasing weights of toner particles and thus the toner particles become more difficult to be released from the photoconductor.

To solve these problems, an image forming apparatus described in JP-A No. 2004-177555 is arranged to collect toner without using a cleaning member utilizing a higher transfer property of toner having been spherical-shaped. Nevertheless, when toner has smaller particles, it is difficult to reliably remove toner in the cleaning-less system.

Accordingly, it is necessary to obtain toner that is suitable for cleaning with the use of a cleaning member, as well as that has spherical shaped particles. In a cleaning step for cleaning toner special-shaped and smaller particle-sized from on the image bearing member, as unit for removing toner left on the image bearing member after transfer operation, a blade cleaning system is employed due to the simple structure and superior removable capability. However, a cleaning blade removes toner while sliding on the surface of an image bearing member, so that the edge portion of a cleaning blade is deformed owing to frictional resistance with the image bearing member, and thus a minute space is made between the image bearing member and the cleaning blade. In this space, the smaller toner particles are, the more likely toner is to get in. The more spherical-shaped toner having got in is, the smaller rolling frictional force is. Consequently, a problem exits in that toner begins to roll in the space between the image bearing member and the cleaning blade, and gets through the cleaning blade, leading to cleaning defects.

As a means of solving such problems, the following deformed toner is proposed in Japanese Patent Application Laid-Open (JP-A) No. 08-044111. This toner is obtained by applying an external force to a spherical toner including at least a low softening-point substance and colorant, as well as having a storage elastic modulus G' of $8.00\times10^{3}<G'\leqq1.00\times10^{9}$ dyne/cm$^2$. With this proposal, however, since deformation treatment keeping the spherical shape of toner is not achieved, a transfer property of toner cannot be maintained.

Further, Japanese Patent Application Laid-Open (JP-A) No. 2000-122347 has an object of providing an image forming method in which there are no cleaning defects even if a spherical toner is used. In this image forming method, used is a developer in which (i) spherical carrier, (ii) spherical toner, and (iii) volume average particle diameter is 1 μm to 8 μm; shape factors SF-1>140 and SF-2>130 are met; and 0.5% to 15% additives are contained by volume of a carrier at the start of image forming.

In the case where still smaller particle-sized toner is required, however, the image forming method of regulating the content of additives having specified shape factors as described in the JP-A No. 2000-122347 is insufficient as unit for improving a cleaning property in blade cleaning system, and thus the occurrence of cleaning defects cannot be prevented.

In addition, proposed is the method in which with a shape factor SF-1, being an index of representing degrees of circularity of a toner particle to be used, and a shape factor SF-2, being an index of representing degrees of concavities and convexities of a toner particle, the shape of toner is regulated, and thus the shape of toner is controlled, to improve a cleaning property.

For example, in Japanese Patent Application Laid-Open (JP-A) No. 2004-053916, the following cleaning unit is proposed. This cleaning unit is constructed such that a cleaning blade and a cleaning brush are disposed in the state of in contact, the nearest distance between the contact edge of the cleaning blade in contact with a transfer belt, and a cleaning brush radius with respect to this contact edge is 0.5 mm to 3 mm, and a counter-rotation amount is a distance between the contact edge of the cleaning belt, and the contact point of the cleaning brush with respect to the transfer belt, or more. In this proposed cleaning unit, used it toner which average circularity is 0.90 to 0.99, shape factor SF-1 is 120 to 180, which shape factor SF-2 is 120 to 190, and which Dv/Dn ratio is 1.05 to 1.30, and which surface includes concavo-convex shape.

However, in the case where the surface of toner is concavo-convex-shaped as in the JP-A No. 2004-053916, since the contact frequency between toner concavities and a carrier comes to be decreased, there will be defects of slow charge rise in the beginning, or less charge density.

As procedures of improving such charge properties of toner, for example, in a pamphlet of International Publication No. WO2004/086149, proposed is toner containing at least one kind of inorganic fine particles in an internal part of a toner base particle. In this proposal, inorganic fine particles contained in toner uniformly reside in an internal part of toner, it is possible to stabilize a charge property. Furthermore, since the burial of external additives can be prevented, it is possible to improve a flow property.

However, the image forming method of the invention described in the International Publication No. WO2004/086149, since the toner surface is not deformed unevenly, includes no function to improve a cleaning property.

Moreover, in the fixing step of the image forming method, the releasing property (hereinafter, may be referred to as "offset resistance") of toner particles with respect to a heating member is required. This offset resistance can be improved by causing a releasing agent to be resided on the toner particle surface. For example, proposed is the method of improving an offset resistance by causing inorganic fine particles to be localized on the surface of toner particles.

In this proposal, however, a fixing lower limit temperature rises, and low-temperature fixing property, that is, energy saving fixing property is insufficient. In the low-temperature fixing system where still lower fixing is required, a problem exits in that fixing inhibition with inorganic fine particles localized on the toner surface occurs, and thus a sufficient fixing temperature range cannot be obtained.

SUMMARY OF THE INVENTION

It is an object of the present invention to provide an image forming method and an image forming apparatus having an excellent offset resistance and an excellent low temperature fixing property, by using toner having excellent cleaning properties and excellent chargeability and preferably together with a fixing unit of specified electromagnetic induction heating system.

As a result of much keen examination by the present inventors to solve the problems, the following art has been found to be important. Although in a conventional toner, deformation treatment is made mainly by applying a shear force to toner particles in order to improve a cleaning property, since the shape of toner preferably remains to be spherical for higher transfer properties of toner, and recently toner tends to be of smaller particle-sized, keeping the spherical shape of toner has been found to be important to maintain transfer properties thereof.

In this case, due to the fact that a high concentration of inorganic fine particles are present in a near-surface region of a toner base particle, the concavo-convex shape on the toner surface becomes marked, and thus toner subjected to deformation treatment to achieve good cleaning property.

However, in toner subjected to such deformation treatment, since the contact frequency of concavities on the surface with a carrier comes to be decreased, toner comes to obtain no sufficient charge density, and there will be slow charge rise in the beginning, or less density. Thus, there may be the occurrence of such defects as toner splash or background smear of images.

As a result of further keen examination by the present inventors to solve the above-the defects, the following art has been found to be capable of providing the following toner. In this toner, a charge control agent is externally added to a toner mother having been subjected to deformation treatment, thereby leading to the state in which a part of inorganic fine particles having been internally added are exposed on the toner base particle surface. The charge control agent having been externally added is interacted with these inorganic fine particles on the surface to obtain an advantage of making up a charge performance of the whole toner particle, and thus toner having an excellent offset resistance as well as and excellent low-temperature fixing property.

An image forming method according to the present invention includes forming a latent electrostatic image on the latent electrostatic image bearing member, developing the latent electrostatic image using a toner to form a visible image, transferring the visible image to a recording medium, and fixing a transfer image transferred on the recording medium, wherein the toner comprises a toner base particle containing at least a binder resin, a colorant and inorganic fine particles, and a charge control agent, and wherein the condition $X_{surf}>X_{total}$ is satisfied (where $X_{surf}$ represents an average proportion of the inorganic fine particles present in a near-surface region of the toner base particle, and $X_{total}$ represents an average proportion of the inorganic fine particles present in the whole toner base particle).

In this case, in the fixing step, fixing is made using a fixing unit, and this fixing unit preferably includes a heating roller which is made of a magnetic metal and is heated by electromagnetic induction, a fixing roller disposed in parallel to this heating roller, a toner heating medium which is formed of an endless strip stretched between the heating roller and the fixing roller and which is heated by this heating roller and rotated by these rollers, and a pressure roller which is pressed against the fixing roller through the toner heating medium and which is rotated in a direction in which the toner heating medium moves to thereby form a nip portion.

In the image forming method according to the present invention, with the use of toner good in cleaning properties and good in chargeability, as well as an excellent offset resistance and an excellent low-temperature fixing property, and a fixing unit of electromagnetic induction heating system, high quality images with no background smear can be obtained.

An image forming apparatus includes a latent electrostatic image bearing member, latent electrostatic image forming unit configured to form a latent electrostatic image on the latent electrostatic image bearing member, developing unit configured to develop the latent electrostatic image using a toner to form a visible image, transfer unit configured to transfer the visible image to a recording medium, and fixing unit configured to fix the transferred image on the recording medium, wherein the toner comprises a toner base particle containing at least a binder resin, a colorant and inorganic fine particles, and a charge control agent, and wherein the condition $X_{surf}>X_{total}$ is satisfied (where $X_{surf}$ represents an average proportion of the inorganic fine particles present in a near-surface region of the toner base particle, and $X_{total}$ represents an average proportion of the inorganic fine particles present in the whole toner base particle).

In this case, the fixing unit preferably includes a heating roller which is made of a magnetic metal and is heated by electromagnetic induction, a fixing roller disposed in parallel to this heating roller, a toner heating medium which is formed of an endless strip stretched between the heating roller and the fixing roller and which is heated by this heating roller and rotated by these rollers, and a pressure roller which is pressed against the fixing roller through the toner heating medium and which is rotated in a direction in which the toner heating medium moves to thereby form a nip portion.

In the image forming apparatus according to the present invention, with the use of toner good in cleaning properties and good in chargeability, as well as of an excellent offset resistance and an excellent low-temperature fixing property, and a fixing unit of electromagnetic induction heating system, high quality images with no background smear can be obtained.

BRIEF DESCRIPTON OF THE DRAWINGS

DESCRIPTION OF THE PREFERRED EMBODIMENTS

Figure 1:
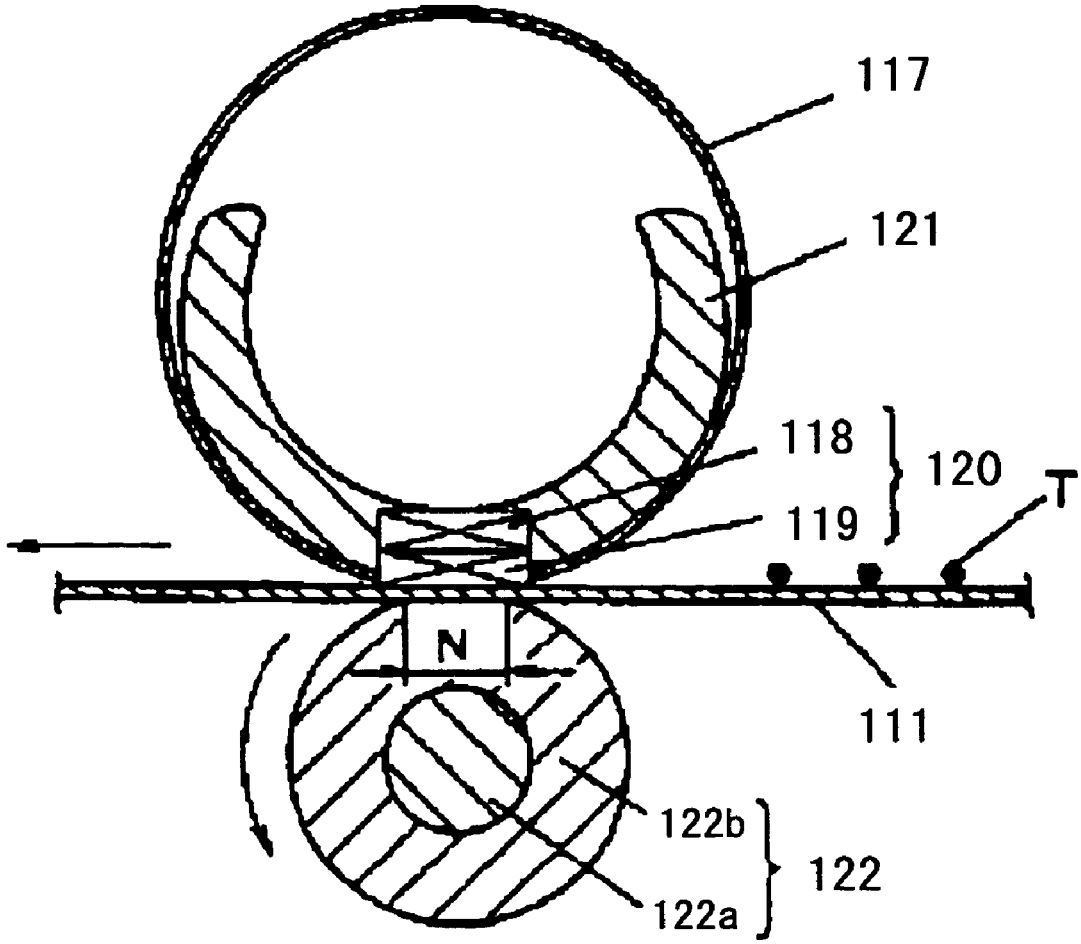
FIG. 1 is a schematic view showing a fixing unit of conventional electromagnetic induction heating system.

<Image Forming Method and Image Forming Apparatus>

The image forming apparatus of the invention contains an latent electrostatic image bearing member, a latent electrostatic image forming unit, a developing unit, a transferring unit and a fixing unit, and further contains additional units such as a charge eliminating unit, a cleaning unit, a recycling unit and a controlling unit, which are optionally selected as needed.

The image forming method of the present invention contains at least a latent electrostatic image forming step, a developing step, a transferring step and a fixing step, and further contains additional steps such as a charge eliminating step, a cleaning step, a recycling step and a controlling step, which are optionally selected as needed.

The image forming process. according to the present invention may be properly carried out by the image forming apparatus according to the present invention. The latent electrostatic image forming step may be performed by the latent electrostatic image forming unit, the developing step may be performed by the developing unit, the transferring step may be performed by the transferring unit, and the fixing step may be performed by the fixing unit. The others may be performed by the other unit.

—Latent Electrostatic Image Forming Unit and Latent Electrostatic Image Forming—

The latent electrostatic image forming step is a step of forming a latent electrostatic image on a latent electrostatic image bearing member.

The material, shape, size, structure, and several features of the latent electrostatic image bearing member are not particularly limited. The latent electrostatic image bearing member can be appropriately selected from those known in the art. However, a drum shaped-latent electrostatic image bearing member is a suitable example. For the material constituting the latent electrostatic image bearing member, inorganic photoconductive materials such as amorphous silicon and selenium, and organic photoconductive materials such as polysilane and phthalopolymethine are preferable. Among these, amorphous silicon is preferable in view of its long life.

As the amorphous silicon photoconductor, employed is a photoconductor that is manufactured, for example, by heating a support element at 50° C. to 400° C. to include a photoconductive layer made of a-Si (hereinafter, may also be referred to as "a-si photoconductor) by film formation methods such as vacuum deposition, sputtering, ion-plating, heat CVD method, optical CVD method, and plasma CVD method. Out of these methods, preferred is the plasma CVD method, that is, the method in which a raw material gas is decomposed with a direct current, high frequency, or microwave glow discharge, and an a-Si deposition film is formed on a support.

The formation of the latent electrostatic image is achieved by, for example, exposing the latent electrostatic image bearing member imagewisely after equally charging its entire surface. This step is performed by means of the latent electrostatic image forming unit. The latent electrostatic image forming unit contains a charging device configured to equally charge the surface of the latent electrostatic image bearing member, and an exposing device configured to expose imagewisely the surface of the latent electrostatic image bearing member.

The charging step is achieved by, for example, applying voltage to the surface of the latent electrostatic image bearing member by means of the charging device.

The charging device is not particularly limited and can be appropriately selected depending on the intended purpose, examples include known contact-charging devices equipped with a conductive or semiconductive roller, blush, film or rubber blade, and known non-contact-charging devices utilizing corona discharge such as corotron or scorotoron.

The charging member may be configured to be in any form, such as a magnetic brush or a fur brush other than a roller. These charging members may be selected depending on the specification or form of electrophotographic machines. In the case of using a magnetic brush, the magnetic brush uses various ferrite particles, for example, Zn—Cu ferrites as a charging member, and is constructed of a non-magnetic conductive sleeve for supporting these ferrite particles, and a magnet roll contained therein. Alternatively, in the case of using a brush, a fur having been processed to be conductive with carbon, copper sulfide, a metal, or a metal oxide is used as material of a fur brush, and this fur is wound or attached to a metal or other core metals having been processed to be conductive, to be a charger.

Although the chargers are not limited to the contact-type chargers, an image forming apparatus in which ozone generated from the chargers is reduced can be obtained, so that it is preferred to use contact-type chargers.

The exposing step is achieved by, for example, exposing the surface of the photoconductor imagewisely by means of an exposing unit.

The exposing device is not particularly limited as long as it is capable of performing imagewise exposure on the surface of the charged latent electrostatic image bearing member by means of the charging device, and may be appropriately selected depending on the intended use. Examples thereof include various exposing devices, such as optical copy devices, rod-lens-eye devices, optical laser devices, and optical liquid crystal shatter devices.

Note in the present invention that a backlight system may be employed for exposure, where imagewise exposure is performed from the back side of the latent electrostatic image bearing member.

—Developing and Developing Unit—

The developing step is a step of developing the latent electrostatic image using the toner of the present invention or developer to form a visible image.

Forming the visible image may be conducted by, for example, developing the electrostatic latent with the use of the toner or the developer, and may be conducted with the developing unit.

The developing unit is not particularly limited insofar as are capable of making development with the use of the toner or the developer, and may be suitably selected out of known ones. For example, the ones that at least include a developing unit capable of containing therein the toner or developer according to the present invention, and of applying this toner or this developer to the electrostatic latent in a contact or non-contact way are preferred.

<Toner>

The toner contains a toner base particle including at least a binder resin, a colorant and inorganic fine particles, and a charge control agent, and further contains other components as necessary.

The toner is in the state in which inorganic fine particles are contained in a toner, and a part of these inorganic fine particles are exposed at the toner surface in a sectional image obtained by observation using a transmission electron microscope (TEM). Herein, the internally contained state means a state in which inorganic fine particles are at least present on the outermost surface, but in an internal part of a toner base particle.

Supposing that the inorganic fine particles are not contained in toner at all, but are fully exposed outside of a toner base particle; or these inorganic fine particles are adsorbed on the toner particle surface, and the toner base particle surface is covered with these inorganic fine particles, uneven deformation of toner cannot be desired, as well as, as properties of the surface or bulk of toner, properties of inorganic fine particles are dominant, and properties of a toner binder resin is unlikely to reveal.

Whereas, supposing that inorganic fine particles are internally contained, as well as a part of these inorganic fine particles are exposed on the toner surface, properties of a binder resin come to be likely to reveal, and low-temperature fixing property is improved. Moreover, in the case of containing wax, since wax is likely to penetrate at the operation of heat set, hot offset resistant property is improved.

Accordingly, inorganic fine particles that are contained in toner are present in a near-surface of a toner base particle at a high concentration, forming an inorganic fine particle layer.

Like this, due to that an inorganic fine particle layer is formed in the vicinity of the surface of a toner base particle, in a process for removing solvent in the manufacturing method of toner, in volume shrinkage of a toner base particle, since a surface area decrease speed is markedly lower than a volume shrinkage speed, a toner base particle surface is made moderately elastic, viscosity at the particle surface comes to be higher than that in an internal part of the particle, concavo-convex shape on the surface is thought to form.

In addition, as described in the embodiments described below, by controlling silica dispersion strength into an oil phase when inorganic fine particles are dispersed in an oil phase, it also comes to be possible that inorganic fine particles are localized on the toner surface.

In the present invention, an average proportion $X_{surf}$ of the inorganic fine particles in a near-surface region of the toner base particle, and an average proportion $X_{total}$ of the inorganic fine particles in the whole toner base particle, satisfy the condition $X_{surf}>X_{total}$.

In this case, the average proportion ratio $X_{surf}$ of inorganic fine particles in the near-surface region of the toner base particle represents an average proportion of inorganic fine particles that are present in the toner base material in a region within 200 nm from the surface thereof in its sectional image obtained using a transmission electron microscope (TEM).

In toner satisfying such a condition, concavo-convex shape on the surface becomes marked, thus making it possible to reveal an excellent cleaning property. Moreover, inorganic fine particles reside in the vicinity of the surface of a toner base particle function to hold stable charge density even over time, thus making it possible to suppress the decrease in charge density owing to toner deterioration.

The average proportion $X_{surf}$ of inorganic fine particles that are present in the region within 200 nm from the toner base particle surface is preferably 50% to 98%, and the average proportion $X_{total}$ of inorganic fine particles in the whole toner base particle is preferably 1% to 50%.

When the average proportion $X_{surf}$ is less than 50%, since the difference in organic fine particle's concentration between the region near the surface of a toner base particle and the entire toner is small, sufficient concavo-convex shape is not formed on the toner surface. In addition, since inorganic fine particles cannot be exposed at the toner particle surface, there are some cases of lower electrostatic charge property. If the proportion $X_{surf}$ exceeds 98%, inorganic fine particles have a lot of exposure to the outside, there are some cases where fixing property is impaired, and low-temperature fixing property becomes worse.

When the average proportion $X_{total}$ exceeds 50%, since a difference between concentrations of inorganic fine particles in the near-surface region and in the internal region of a toner base particle comes to be smaller, there will be no formation of concavo-convex shape accompanied by the volume shrinkage at the time of de-solventization, and there are some cases of worse low-temperature fixing property. On the other hand, when the proportion $X_{total}$ is less than 1%, there are some cases where concavo-convex shape on the surface accompanied by volume shrinkage is not formed well.

Further, although it is preferable that an inorganic fine particle layer be formed along the surface shape (concavo-convex shape) of a toner base particle, it is unnecessary to provide an inorganic fine particle layer that occupies almost all the near-surface region of a toner base particle.

Herein, the average proportions $X_{surf}$ and $X_{total}$ of the inorganic fine particles are obtained as follows. In this method, for example, a toner base particle is dispersed in a saturated aqueous solution of 67% by mass sucrose, is frozen at −100° C., thereafter is sliced in a thickness of about 1,000 angstrom with a cryomicrotome (EM-FCS, manufactured by Laica), and is photographed in a particle section at a magnification of 10,000 times with a transmission electron microscope (JEM-2010, manufactured by JEOL Ltd.). Further, an area proportion $X_{surf}$ of inorganic fine particle shadows in the region of a part of 200 nm thickness in a vertical direction in an internal part of a particle from the surface of a toner particle, and an area proportion $X_{total}$ of inorganic fine particle shadows in the total region of a toner base particle sectional image, in a section which cross section is the maximum, using an image analyzer (nexus NEW CUBE ver. 2.5, manufactured by NEXUS). Moreover, this measurement is done with ten particles selected at random, and an average of respective values is taken as a measured value.

Furthermore, the thickness of an inorganic fine particle layer that is formed in the vicinity of the surface of the toner base particle can be measured by making an image analysis of an image in a resin particle section using a transmission electron microscope (TEM).

That is, toner is dispersed in a saturated aqueous solution of 67% by mass sucrose, is frozen at −100° C., and thereafter is sliced in a thickness of about 1,000 angstrom with cryomicrotome. Then, inorganic fine particles are dyed with ruthenium tetroxide, and thereafter a resin particle section is photographed at a magnification of 10,000 times with a transmission electron microscope. Using an image analyzer (nexus NEW CUBE ver. 2.5, manufactured by NEXUS), in a section which cross section is the maximum, the maximum distance where the area of an inorganic fine particle layer occupies 50% or more in the area of a part of a predetermined distance in a vertical direction in an internal part of a particle from the surface of a toner particle, is taken as the thickness of an inorganic fine particle layer. Moreover, the above measured value is an average of respective calculated values with ten resin particles selected at random.

In addition, in the case where an inorganic particle layer and resin are hard to identify in observing a TEM image, mapping of a resin particle section having been obtained by the above-the method with various apparatuses capable of making a composition mapping (for example, an energy dispersive X-ray spectroscopic apparatus: EDX, electron energy loss spectroscopic apparatus: EELS) is made, an inorganic fine particle layer is specified from a composition distribution image having been obtained by analysis, and the thickness of an inorganic fine particle layer can be calculated by the above-the method.

The thickness of the inorganic fine particle layer, normally, is preferably 0.005 μm to 0.5 μm, more preferably 0.01 μm to 0.2 μm, and still more preferably 0.02 μm to 0.1 μm.

Such an inorganic fine particle layer may be formed by manufacturing a toner base particle in processes in which a toner material solution in which at lest a binder resin and filler are dispersed and/or dissolved in an organic solvent is dispersed in an aqueous medium, a liquid droplet having been obtained is to be a solid particle, and the solvent and water (hereinafter, collectively referred to as "e.g., solvent") is removed and dried.

The concavo-convex shape on the surface of a toner base particle is thought to form in the process for removing the above-the solvent and the like. In this process, when the volume of a toner base particle is shrunk, due to that an inorganic fine particle layer is formed, the decrease rate of a surface area is significantly smaller than the shrinkage rate of a volume, a toner base particle surface is made suitably elastic, and viscosity of the particle surface is higher than that in an internal part of the particle.

—Inorganic Fine Particles—

The inorganic fine particles may be suitably selected depending on the purpose without particular limitation. Examples of the inorganic fine particles include metal oxides such as silica, diatom earth, alumina, zinc oxide, titania, zirconia, calcium oxide, magnesium oxide, iron oxide, copper oxide, tin oxide, chromium oxide, antimony oxide, yttrium oxide, cerium oxide, samarium oxide, lanthanum oxide, tantalum oxide, terbium oxide, europium oxide, neodymium oxide, and ferrites; metalhydroxides such as calcium hydroxide, magnesium hydroxide, aluminum hydroxide, and basic magnesium carbonate; metal carbonates such as heavy calcium carbonate, light calcium carbonate, zinc carbonate, barium carbonate, dawsonite, and hydrotalcite; metal sulfates such as calcium sulfate, barium sulfate, and plaster fiber; metal silicates such as calcium silicate (wallasnite, xonotlite), kaolin, clay, talc, mica, montmorillonite, bentonite, activated white earth, sepiolite, imogolite, serisite, glass fiber, glass beads, and glass flakes; metal nitrides such as aluminum nitride, boron nitride, and silicon nitride; metal titanates such as potassium titanate, calcium titanate, magnesium titanate, barium titanate, and lead zirconate titanate aluminum borate; metal borates such as zinc borate, and aluminum borate; metal phosphates such as tricalcium phosphate; metal sulfates such as molybdenum sulfate; metal carbides such as silicon carbide; and carbons such as carbon black, graphite, and carbon fiber. Out of them, metal oxides are preferred, and silica, alumina, and titania are particularly preferred.

The inorganic fine particles are preferably present so as to be contained in a toner, as well as so that a certain amount thereof are exposed at the surface of a toner base particle. With inorganic fine particles exposed on the surface, it is possible to improve toner flowability, and to obtain a high chargeability.

Furthermore, when using inorganic fine particles including a hydroxyl group such as silica and using a cationic surfactant as a charge control agent, hydroxyl groups on the inorganic fine particle surface that are exposed on the toner surface and the charge control agent are bonded together with ion bonds or physically adsorbed, and thus, by the interaction thereof, still higher charge rise property and high charge density can be obtained.

Therefore, it is possible to suppress the amount of an external additive to be added thereafter as a charge application agent to be a small amount, to suppress the separation of external additives, and further to prevent these separated external additives from filming on the surface of a photoconductor and a carrier.

As inorganic fine particles internally added into a toner particle, silica is particularly preferred.

Further, in the case of letting internal additive-inorganic fine particles silica, a surface silicon atomic concentration from silica exposed on the toner base particle surface is preferably 0.5% by atomic number to 10 atomic % by number, more preferably from 1 atomic % by number to 5 atomic % by number. When the surface silicon atoms are less than 0.5 atomic % by number, flowability is insufficient, and since a sufficient charge effect cannot be obtained, chargeability may be unstable. When the surface silicon atoms exceed 10 atomic % by number, as surface and bulk properties of toner, properties of inorganic fine particles come to be dominant, and properties of a toner binder resin become less likely to reveal.

Herein, the concentration of silicon atoms derived from silica present on the surface of the toner base particle can be measured by XPS (X-ray photoelectron spectroscopy) method. Moreover, the toner surface unit the region of the extremely outermost surface of about several nm of the toner surface.

The concentration of silicon atoms from silica is measured using X-ray photoelectron spectroscopic apparatus of 1600S type manufactured by PHI Co. with x-ray source MgKα (400 W) and with an analysis region 0.8 mm×2.0 mm. Furthermore, as pretreatment, a sample is charged in an aluminum pan, and adhered to a specimen holder with a carbon sheet to be measured. A surface atomic concentration is calculated using a relative sensitivity factor provided by PHI Co.

The silica is preferred to use in the state of organosol. To obtain such an organosol silica, for example, there may be the method, in which, a dispersion of hydrogel silica having been synthesized by a wet method (hydrothermal synthesis method, or sol-gel method) is subjected to a hydrophobic treatment with a surface treatment agent, and water is replaced with organic solvents such as methylethylketone and ethyl acetate The specific manufacturing method of the organosol may preferably employ the method described in, for example, JP-A No. 11-43319.

By admixing the obtained organosoilicasol into a toner oil phase, silica can be dispersed in the toner oil phase in the state of high dispersion stability.

In addition, the dispersion methods of inorganic fine particles to be internally added into toner, including the above-described silica, are not particularly limited, known methods may be applied, and, for example, the following dispersion methods may be used: (1) a method in which a binder resin and inorganic fine particles are melted, and mixed and kneaded by a mixer in the presence of a solvent and/or a dispersant as necessary to obtain a master batch in which inorganic particles are dispersed in the binder resin; (2) a method in which inorganic fine particles are dissolved and suspended in a solvent along with a binder resin as necessary, and thereafter milled by wet method or cracked mechanically by a disperser; (3) a method in which inorganic particles having been synthesized in a solvent are added and mixed, (4) a method in which inorganic fine particles that are dispersed in water is added with a treatment agent to be treated by a wet method, and thereafter added with organosol which solvent is replaced, and mixed.

Out of these methods, from a viewpoint of dispersion stability, preferred is the method in which inorganic fine particles that are dispersed in water is added with a treatment agent to be treated by wet method, and thereafter added with organosol which solvent is replaced, and mixed.

The average primary particle diameter of the inorganic fine particles is preferably 100 nm or less, more preferably 10 nm to 60 nm. When the average primary particle diameter exceeds 100 nm, since a particle size of inorganic fine particles is too large with respect to a toner particle, the formation of concavo-convex shape on the toner particle surface may not proceed.

Herein, in the case where an average primary particle diameter of inorganic fine particles is 0.1 μm or more, measurement with the use of laser-type particle size distribution measurement equipment is preferred. Furthermore, in the case where an average primary particle diameter of inorganic fine particles is 0.1 μm or less, calculation with BET specific surface area and true specific gravity is preferred.

The BET specific surface area can be measured using equipment based on the normal nitrogen absorption method, and, for example, the trade-name: QUQNTASORB (manufactured by QUANTACHROME Co.) may be used. A volume average particle diameter of a primary particle of inorganic fine particles can be measured by dividing an inverse number of a BET specific surface area of inorganic fine particles by a true specific gravity of inorganic fine particles.

The inorganic fine particles are preferred to employ the ones that are subjected to surface treatment with a hydrophobic treatment agent. Examples of these hydrophobic treatment agents include a silane coupling agent, a sililating agent, a silane coupling agent including a fluorinated alkyl group, an organic titanate coupling agent, and an aluminate coupling agent. Further, with the ones that are subjected to surface treatment by using silicone oil as a hydrophobic treatment agent, a sufficient effect can be obtained.

The inorganic fine particles are subjected to hydrophobic treatment as mentioned above to have a degree of hydrophobicity of 15% to 55% by the methanol titration method. By using inorganic fine particles whose degree of hydrophobicity falls within this range, deformation preferably goes on, and thus the suitable concavo-convex shape can be formed on the surface of an obtained toner.

Herein, the degree of hydrophobicity is obtained in the following process. First, 50 ml of an ion-exchange water and 0.2 g of sample are put in a beaker, and methanol is added dropwise under stirring. Then, external additives are made to precipitate by degrees as a methanol concentration in the beaker is increased. The mass proportion of methanol in a mixed solution of methanol and water at the endpoint when all external additives have been precipitated is defined as the degree of hydrophobicity (%).

—Charge Control Agent—

The charge control agents may be suitably selected depending on the purpose out of known ones without limitation, and may employ, for example, a fluorochemical surfactant, an anionic surfactant, and a cationic surfactant.

Examples of the anionic surfactants include alkylbenzene sulfonate, α-olefin sulfonate, and phosphate.

Examples of the cationic surfactants include amine salts such as alkyl amine salts, amino alcohol fatty acid derivative, polyamine fatty acid derivative, and imidazoline; or quaternary ammonium salts such as alkyltrimetylammonium salt, dialkyldimetylammonium salt, alkyldimetylbenxyl ammonium salt, pyridinium salt, alkylisoquinolinium salt, and benzethonium chloride.

Further, when necessary, nonionic surfactants or amphoteric surfactants may be used. Examples of the nonionic surfactants include a fatty acid amide derivative and a polyhydric alcohol derivative. Examples of the amphoteric surfactants include alanine, dodecyl-di-(amino ethyl) glycine, di-(octylamino ethyl) glycine, and N-alkyl-N, and N-dimethyl ammonium betaine.

The used amount of these surfactants may be suitably selected depending on the purpose without limitation, and preferably 0.1% by mass to 10% by mass based on the total aqueous phase mass.

By using the fluorochemical surfactants, favorable effects of chargeability, and particularly a charge rise property can be obtained.

Examples of the fluorochemical surfactants, as anionic surfactants having fluoroalkyl groups include fluoroalkyl carboxylic acids having from 2 to 10 carbon atoms and metal salts thereof, disodium perfluorooctansulfonylglutamate, sodium 3-[omega-fluoroalkyl(C6-C11)oxy]-1-alkyl(C3-C4) sulfonate, sodium 3-[omega-fluoroalkanoyl(C6-C8) -N-ethylamino]-1-propansulfonate, fluoroalkyl(C11-C20) carboxylic acids and metal salts thereof, perfluoroalkyl (C7-C13)carboxylic acids and metal salts thereof, perfluoroalkyl (C4-C12)sulfonate and metal salts thereof, perfluorooctanesulfonic acid diethanol amide, N-propyl-N-(2-hydroxyethyl) perfluorooctanesulfone amide, perfluoroalkyl(C6-C10) sulfoneamidepropyltri-methylammonium salts, perfluoroalkyl (C6-C10)-N-ethylsulfonyl glycin salts, and monoperfluoroalkyl(C6-C16)ethylphosphates.

Examples of commercially available products of the fluorochemical surfactants include SURFLON S-111, S-112 and S-113 (manufactured by Asahi Glass Co., Ltd.); FRORARD FC-93, FC-95, FC-98 and FC-129 (manufactured by Sumitomo 3M Ltd.); UNIDYNE DS-101 and DS-102 (manufactured by Daikin Industries, Ltd.); MEGAFACE F-110, F-120, F-113, F-191, F-812 and F-833 (manufactured by Dainippon Ink and Chemicals, Inc.); ECTOP EF-102, 103, 104, 105, 112, 123A, 123B, 306A, 501, 201 and 204 (manufactured by Tohchem Products Co., Ltd.); and FUTARGENT F-100 and F150 (manufactured by Neos). Examples of the cationic surfactants include primary, secondary and tertiary aliphatic amines having a fluoroalkyl group, aliphatic quaternary ammonium salts such as perfluoroalkyl(C6-C10)sulfoneamidepropyltrimethylammonium salts, benzalkonium salts, benzetonium chloride, pyridinium salts, and imidazolinium salts. Examples of commercially available products of the cationic surfactants include SURFLON S-121 (manufactured by Asahi Glass Co., Ltd.); FRORARD FC-135 (manufactured by Sumitomo 3M Ltd.); UNIDYNE DS-202 (manufactured by Daikin Industries, Ltd.); MEGAFACE F-150 and F-824 (manufactured by Dainippon Ink and Chemicals, Inc.); ECTOP EF-132 (manufactured by Tohchem Products Co., Ltd.); and FUTARGENT F-300 (manufactured by Neos).

Out of these surfactants, particularly cationic surfactants are preferred to use. When using the ones that include a hydroxyl group such as silica as inorganic fine particles to be internally added to a toner particle, hydroxyl groups on the fine particle surface that are exposed on the toner surface and the charge control agent are ionically bonded or physically adsorbed, and thus, by the interaction thereof, still higher charge rise property and high charge density can be obtained.

Out of them, with the use of a fluoride-containing quaternary ammonium salt compound as shown with general formula (1) below, a stable developer having a smaller change of charge density when environments are changed can be obtained.

general formula (1)

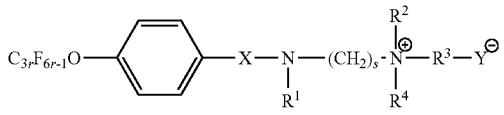

where X represents —$SO_2$— or —CO—, $R^1$, $R^2$, $R^3$ and $R^4$ independently represent a group selected from a hydrogen atom, alkyl groups of 1 to 10 carbon atoms, and aryl groups, Y represents an iodine atom, bromine atom or chlorine atom, "r" represents an integer of 1 to 20, and "s" represents an integer of 1 to 20.

In the case where a fluoride-containing compound is used as the charge control agent, the content of fluorine atoms derived from a fluoride-containing compound, as determined by XPS, is preferably 2.0 atomic % by number to 15 atomic % by number, more preferably 3 atomic % by number to 10 atomic % by number. When the content of the fluorine atoms as determined by X-ray electron spectroscopy (XPS) is less than 2.0 atomic % by number, since a sufficient charge effect cannot be obtained, not only the decrease of an initial chargeability but also the charge decrease with time are likely to occur, and thus a problem may exist in background smear of an image, toner splash, and the like. When exceeding 15 atomic % by number, image density defects, and further fixing defects of a developer due to high electrostatic charge may occur.

In addition, measurement of fluorine atoms by XPS method can be made by the same method as measurement of inorganic fine particles on the toner surface, which the having been internally added thereto.

When the toner surface is concavo-convex shaped as mentioned above, since concavities cannot be in contact with a carrier, the contact area between toner and carrier is decreased, resulting in the reduction in chargeability, and particularly in initial charge rise speed of toner itself.

In the toner, a charge control agent is externally added to the toner base particle surface where a high concentration of inorganic fine particles exists, to make up the decrease of an electrostatic chargeability as mentioned above. Owing to that a charge control agent is externally added like this, this charge control agent can interact with inorganic fine particles exposed and resided on the above-described particle surface. In the case where a charge control agent is internally added, such an effect cannot be obtained. Consequently, the toner according to the present invention can be a toner having an excellent cleaning property while having an excellent initial charge rise property, as well as having no decrease of charge density with time and keeping a highly stable electrostatic chargeability.

Further, a charge control agent is preferably added externally by wet method. External addition by wet method is made by causing a charge control agent fine particle dispersion to be present in a slurry of toner base particles are dispersed again in an aqueous medium.

Due to that an external addition by wet method is done like this, charge control agents are uniformly applied onto the toner surface, the reduction of electrostatic charge density of toner accompanied by decreased contact frequency between the surface concavities and carrier can be reliably made up.

The content of the charge control agents is preferably 0.05% by mass to 1% by mass, more preferably 0.1% by mass to 0.3% by mass based on the toner mass.

Manufacturing methods or materials of the toner, insofar as the above-mentioned conditions are met, are not particularly limited, and may be suitably selected from those known in the art depending on the purpose. For example, to output images of high resolution and high image quality, a substantially spherical toner having concavo-concavities on the surface of a small particle is preferred. Examples of manufacturing methods of such toner include pulverization and classification method, and suspension polymerization method, emulsification polymerization method, and polymer suspension method in which an oil phase is emulsified in an aqueous medium, suspended, or aggregated in an aqueous medium to form a toner base particle.

The pulverization method is the method for obtaining a base particle for toner by melting and kneading toner materials, and by pulverizing and classifying them. Furthermore, in the case of this pulverization method, to increase the average circularity of toner, a mechanical impact force may be applied to toner base particles to round their shapes. In this case, the mechanical impact force may be applied to toner base particles using a device such as a hybridizer or a mechano-fusion.

In the suspension polymerization method, a colorant, a releasing agent and the like are dispersed in an oil soluble polymeric start agent and a polymeric monomer, and emulsified and dispersed by the below-described emulsification method in an aqueous medium in which a surfactant and other solid dispersants are contained. Thereafter, polymerization is made to be in particles, and then treatment by wet method in which inorganic fine particles are adhered to the toner particle surface according to the present invention may be done. In this process, preferably the treatment may be made with respect to a toner particle in which an excess surfactant and the like are cleaned and removed.

By using a part of acrylates and methacrylates including amino groups as the polymeric monomers, for example, acids such as acrylic acid, methacrylic acid, α-cyanoacrylate, α-cyanomethacrylate, itaconic acid, crotonic acid, fumaric acid, maleic acid, and maleic anhydride; acrylamide, methacrylamide, and diacetone acrylamide or methylol compound thereof and vinylpyridine, vinylpyrrolidone, vinylimidazole, ethyleneimine, and dimethylaminoethyl methacrylate, functional groups can be introduced onto the toner particle surface.

Moreover, by selecting the ones that contain acid groups or basic groups as dispersants to be used, a dispersant is made to adsorb and remain on the particle surface, thus enabling to introduce functional groups.

In the emulsification polymerization method, a water-soluble polymeric start agent and a polymeric monomer are emulsified with a surfactant in water, and latex is synthesized by the normal emulsification and polymerization methods. Another dispersion in which a colorant, a releasing agent and the likes are dispersed in an aqueous medium is prepared, and coagulated in toner size after mixing, and melted and deposited by heating to obtain toner. Thereafter, the below-described treatment by wet method of inorganic fine particles may be made. On the supposition of using the same one as a monomer to be usable in the suspension and polymerization method as latex, functional groups can be introduced to the toner particle surface.

According to the present invention, out of these methods, since resin has a high selectivity, a low-temperature fixing property is improved, and an excellent granulation is achieved, and a particle diameter, a particle size distribution, and a shape are easy to control, the toner may be preferably granulated by causing a solution or dispersion of toner materials to be emulsified or dispersed in an aqueous medium.

A solution of the toner materials is obtained by causing the toner materials to dissolve in a solvent. A dispersion of the toner materials is obtained by causing the toner materials to disperse in the solvent.

The toner materials at least contain adhesive base materials obtained by causing an active hydrogen group-containing compound, a polymer capable of being reacted with this active hydrogen group-containing compound, a binder resin, a releasing agent and a colorant to react. The toner materials further contain other components such as resin fine particles and a charge control agent as necessary.

—Adhesive Base Material—

The adhesive base material exhibits an adhesive property with respect to a recording medium such as papers, at least contains an adhesive polymer that is obtained by reacting the active hydrogen group-containing compound and a polymer capable of being reacted with this active hydrogen group-containing compound in the aqueous medium, and further may contain a binder resin suitably selected from known binder resins.

The weight average molecular weight of the adhesive base material may be suitably selected depending on the purpose without particular limitation. This weight average molecular weight is, for example, preferably 1,000 or more, more preferably 2,000 to 10,000,000, still more preferably 3,000 to 1,000, 000.

When the weight average molecular weight is less than 1,000, a hot offset resistance may be worse.

The storage elastic modulus of the adhesive base material may be suitably selected depending on the purpose without particular limitation. For example, temperatures (T'G) of 10,000 dyne/cm$^2$ at a measured frequency 20 Hz is normally 100° C. or more, preferably 110° C. to 200° C. When this (T'G) is less than 100° C., a heat offset resistance may be worse.

The viscosity of the adhesive base material may be suitably selected depending on the purpose without particular limitation. For example, temperatures (Tη) of 1,000 poises at a measured frequency 20 Hz is normally 180° C. or more, preferably 90° C. to 160° C. When this (Tη) exceeds 180° C., a low-temperature fixing property may be worse.

Consequently, in respect of achieving both hot offset resistance and low-temperature fixing property, the (TG') is preferred to be higher than the (Tη). That is, a difference (TG'−Tη) between (TG') ad (Tη) is preferably 0° C. or more, more preferably 10° C. or more, still more preferably 20° C. or more. The larger this difference is, the better it is.

In addition, from the viewpoint of achieving both low-temperature fixing property and heat resistant preserving property, the (TG'−Tη) is preferably 0° C. to 100° C., more preferably 10° C. to 90° C., still more preferably 20° C. to 80° C.

Specific examples of the adhesive base materials may be suitably selected depending on the purpose without particular limitation, and preferably include polyester reins, and the like.

The polyester resins may be suitably selected depending on the purpose without particular limitation, and in particular, preferably include urea modified polyester resin, and the like.

The urea modified polyester resin is obtained by the reaction in the aqueous medium of amines (B) as the active hydrogen group-containing compound, and isocyanate group-containing polyester pre-polymer (A) as a polymer capable of being reacted with this active hydrogen group-containing compound.

The urea modified polyester resin may contain a urethane bond other than a urea bond. In this case, the molar ratio of containing this urea bond and this urethane bond (urea bond/urethane bond) may be suitably selected depending on the purpose without particular limitation, and is preferably 100/0 to 10/90, more preferably 80/20 to 20/80, particularly preferably 60/40 to 30/70.

When the urea bonds are less than 10, a hot offset resistance may be worse.

Specific examples of the urea modified polyester resin preferably include the following (1) to (10): (1) a mixture of urea products with isophorone diamine of polyester prepolymer obtained by reacting with isophorone diisocyanate a polycondensate of bisphenol A ethylene oxide (2 mol) adduct and an isophthalic acid, and polycondensate of bisphenol A ethylene oxide (2 mol) adduct and an isophthalic acid (2) a mixture of urea products with isophorone diamine of polyester prepolymer obtained by reacting with isophorone diisocyanate a polycondensate of bisphenol A ethylene oxide (2 mol) adduct and an isophthalic acid, and a polycondensate of bisphenol A ethylene oxide (2 mol) adduct and an terephthalic acid (3) a mixture of urea products with isophorone diamine of polyester prepolymer obtained by reacting with isophorone diisocyanate a polycondensate of bisphenol A ethylene oxide (2 mol) adduct/bisphenol A propylene oxide (2 mol) adduct and an terephthalic acid, and a polycondensate of bisphenol A ethylene oxide (2 mol) adduct/bisphenol A propylene oxide (2 mol) adduct and an terephthalic acid (4) a mixture of urea products with isophorone diamine of polyester prepolymer obtained by reacting with isophorone diisocyanate a polycondensate of bisphenol A ethylene oxide (2 mol) adduct/bisphenol A propylene oxide (2 mol) adduct and an terephthalic acid, and a polycondensate of bisphenol A propylene oxide (2 mol) adduct and an terephthalic acid (5) a mixture of urea products with hexamethylene diamine of polyester prepolymer obtained by reacting with isophorone diisocyanate a polycondensate of bisphenol A ethylene oxide (2 mol) adduct and a terephthalic acid, and a polycondensate of bisphenol A ethylene oxide (2 mol) adduct and an terephthalic acid (6) a mixture of urea products with hexamethylene diamine of polyester prepolymer obtained by reacting with isophorone diisocyanate a polycondensate of bisphenol A ethylene oxide (2 mol) adduct and an terephthalic acid, and a polycondensate of bisphenol A ethylene oxide (2 mol) adduct/bisphenol A propylene oxide (2 mol) adduct and an terephthalic acid (7) a mixture of urea products with ethylene diamine of polyester prepolymer obtained by reacting with isophorone diisocyanate a polycondensate of bisphenol A ethylene oxide (2 mol) adduct and a terephthalic acid, and a polycondensate of bisphenol A ethylene oxide (2 mol) adduct and an terephthalic acid (8) a mixture of urea products with hexamethylene diamine of polyester prepolymer obtained by reacting with diphenylmethane diisocyanate a polycondensate of bisphenol A ethylene oxide (2 mol) adduct and an isophthalic acid, and a polycondensate of bisphenol A ethylene oxide (2 mol) adduct and an isophthalic acid (9) a mixture of urea products with hexamethylene diamine of polyester prepolymer obtained by reacting with diphenylmethane diisocyanate a polycondensate of bisphenol A ethylene oxide (2 mol) adduct/bisphenol A propylene oxide (2 mol) adduct and an terephthalic acid/dodecenylsuccinic anhydride, and a polycondensate of bisphenol A ethylene oxide (2 mol) adduct/bisphenol A propylene oxide (2 mol) adduct and an terephthalic acid (10) a mixture of urea products with hexamethylene diamine of polyester prepolymer obtained by reacting with toluene diisocyanate a polycondensate of bisphenol A ethylene oxide (2 mol) adduct and an isophthalic acid, and a polycondensate of bisphenol A ethylene oxide (2 mol) adduct and an isophthalic acid —Active Hydrogen Group-Containing Compound—

The active hydrogen group-containing compound acts as extenders and cross linking agents when a polymer capable of being reacted with this active hydrogen group-containing compound is extended and cross-linked in the aqueous medium.

The active hydrogen group-containing compounds may be suitably selected depending on the purpose without particular limitation insofar as they contain active hydrogen radicals. For example, in the case where a polymer capable of being reacted with the hydroxyl group-containing compound is the isocyanate group-containing polyester prepolymer (A), in respect of being capable of having higher molecular weight by the reactions such as extension reaction or cross-linking reaction with this isocyanate group-containing polyester prepolymer (A), the amines (B) are preferred.

The active hydrogen radicals may be suitably selected depending on the purpose without particular limitation, and include, for example, hydroxyl groups (alcoholic hydroxyl groups or phenolic hydroxyl groups), amino groups, carboxyl groups, and mercapto groups. They may be used alone, or two or more of them may be used in combination. Out of them, alcoholic hydroxyl groups are particularly preferred.

The amines (B) may be suitably selected depending on the purpose without particular limitation, and include, for example, diamine (B1), polyamine (B2) having 3 or more valences, amino alcohol (B3), amino mercaptan (B4), amino acid (B5), and blocked amino groups of the B1 to B5 (B6).

They may be used singly or in combination. Out of them, diamine (B1) and a mixture of diamine (B1) and a small amount of 3 or more valences of polyamine (B2) are particularly preferred.

The diamines (B1) include, for example, an aromatic diamine, an alicyclic diamine, and an aliphatic diamine. These aromatic diamines include, for example, phenylenediamine, and diethyltoluenediamine, 4,4' diaminephenylmethane. These alicyclic diamines include, for example, 4,4'-diamine-3,3' dimetyldicyclohexylmethane, diaminecyclohexane, and isophorone diamine. These aliphatic diamines include, for example, ethylene diamine, tetramethylene diamine, and hexamethylene diamine.

The polyamine (B2) having 3 valences or more include, for example, diethylene triamine, and triethylene tetramine.

The amino alcohol (B3) include, for example, ethanolamine and hydroxylethyl aniline.

The aminomercaptan (B4) include, for example, aminoethyl mercaptan and aminopropylmercaptan.

The amino acids (B5) include, for example, aminopropionic acid and aminocaproic acid.

The blocked amino groups of the B1 to B5 (B6) include, for example, ketimine compound and oxazolidine compound that are obtained with any amines of the (B1) to (B5), and any ketones (acetone, methylethyl ketone, methylisobutyl ketone, and the like).

Furthermore, to stop the extension reaction and the cross-linking reaction between the active hydrogen group-containing compound and the polymer capable of being reacted with the active hydrogen group-containing compound, a reaction stopping agent can be used. The use of this reaction-stopping agent is preferred in respect of capable of controlling e.g., molecular weights of the adhesive base materials in a desired range. These reaction-stopping agents include, for example, monoamine (diethylamine, dibutylamine, butylamine, laurylamine, and the like), or the ones that are obtained by blocking these monoamines (ketimine compound).

As the mixing ratio between the amines (B) and the isocyanate group-containing polyester prepolymers (A), the mixing ratio ([NCO]/[NHx]) between isocyanate groups [NCO] in the isocyanate group-containing prepolymers (A) and amino groups [NHx] in the amines (B), on an equivalent weight basis, is preferably 1/3 to 3/1, more preferably 1/2 to 2/1, still more preferably 1/1.5 to 1.5/1.

When the mixing ratio ([NCO]/[NHx]) is less than 1/3, a low-temperature fixing property may be worse. When exceeding 3/1, a molecular weight of the urea modified polyester resin is decreased. A hot offset resistance may be worse.

—Polymer Capable of being Reacted with Active Hydrogen Group-Containing Compound—

The polymers capable of being reacted with an active hydrogen group-containing compound (hereinafter, may be referred to as "prepolymer") may be suitably selected from known resins depending on the purpose without particular limitation insofar as at least they have parts capable of being reacted with the active hydrogen group-containing compound, and include, for example, polyol resins, polyacrylic resins, polyester resins, epoxy resins, and derivative resins.

They may be used singly or in combination. Out of these resins, polyester resins are particularly preferred in respect of a high flowability in the melted state, and a transparency.

Parts capable of being reacted with the active hydrogen group-containing compound in the prepolymer may be suitably selected from known substituent groups depending on the purpose without particular limitation, and include, for example, isocyanate groups, epoxy groups, carboxylic acids, and acid chloride groups.

They may be used singly or in combination. Out of these substituent groups, isocyanate groups are particularly preferred.

Among the prepolymers, in view of the fact that the molecular weights of high molecular components are easy to adjust, that an oil-less low-temperature fixing property in toner manufactured by dry method, and that an excellent releasing property and fixing property are reliably achieved particularly even in the case where there is no releasing oil application mechanism to a fixing heating medium, urea-bond generating group-containing polyester resin (RMPE) are particularly preferred.

The urea bond generating groups include, for example, isocyanate groups. In the case where this urea bond generating group in the urea bond generating group-containing polyester resin (RMPE) is this isocyanate group, the polyester resins (RMPE) particularly preferably include the isocyanate group-containing polyester prepolymers (A).

The isocyanate group-containing polyester prepolymers (A) may be suitably selected depending on the purpose without no particular limitation, and include, for example, the one which is a polycondensate of polyol (PO) and polycarboxylic acid (PC), as well as which is obtained by reacting the active hydrogen group-containing polyester resin with polyisocyanate (PIC).

The polyols (PO) may be suitably selected depending on the purpose without no particular limitation, and include, for example, diol (DIO), polyol (TO) having 3 valences or more, and the mixture of diol (DIO) and polyol (TO) having 3 valneces or more. They may be used alone, or two or more of them may be used in combination. Out of them, the diol (DIO) alone and the mixture of the diol (DIO) and a small amount of the polyol (TO) having 3 valences or more are preferred.

Examples of the diols (DIO) include alkylene glycol, alkylene ether glycol, alicyclic diol, alkylene oxide adducts of alicyclic diol, bisphenols, and alkylene oxide adducts of bisphenols.

The alkylene glycols preferably have 2 to 12 carbon atoms. Examples of the alkylene.glycols include ethylene glycol, 1,2-propylene glycol, 1,3-propylene glycol, 1,4-butanediol, and 1,6-hexanediol. Examples of the alkylene ether glycols include diethylene glycol, triethylene glycol, dipropylene glycol, polyethylene glycol, polypropylene glycol, and polytetramethylene ether glycol. Examples of the alicyclic diols include 1,4-cyclohexane dimethanol and hydrogenated-bisphenol A. Examples of the alkylene oxide adducts of alicyclic diol include adducts of alkylene oxides such as ethylene oxide, propylene oxide, and butylene oxide with respect to the alicyclic diol. Examples of the bisphenols include bisphenol A, bisphenol F, and bisphenol S. Examples of the alkylene oxide adducts of bisphenols include adducts of alkylene oxides such as ethylene oxide, propylene oxide, and butylene oxide with respect to the bisphenols.

Out of them, alkyleneglycols having 2 to 12 carbon atoms, and alkylene oxide adducts of bisphenols are preferred, and alkylene oxide adducts of bisphenols, and a mixture of alkylene oxide adducts of bisphenols and alkyleneglycols having 2 to 12 carbon atoms are particularly preferred.

For the polyols (TO) having 3 valences or more, those having 3 to 8 valences or more are preferable. Examples include polyhydric aliphatic alcohols having 3 valences or more, polyphenols having 3 valences or more, and an alkylene oxide adducts of polyphenols having 3 valences or more.

Examples of the polyhydric aliphatic alcohols having 3 valences or more include glycerin, trimethylol ethane, trimethylol propane, pentaerythritol, and sorbitol. Examples of the polyphenols having 3 valences or more include trisphenol PA, phenol novolac, and cresol novolac. Examples of the alkylene oxide adducts of polyphenols having 3 valences or more include adducts of alkylene oxides such as ethylene oxide, propylene oxide, and butylenes oxide with respect to the polyphenols having 3 valences or more.

The mixing ratio (DIO:TO) between the diol (DIO) and the polyol(TO) having 3 valences or more in the mixture of the diol (DIO) and the polyol(TO) having 3 valences or more, on a mass basis, is preferably 100:0.01 to 100:10, more preferably 100:0.01 to 100:1.

The polycarboxylic acids (PC) may be suitably selected depending on the purpose without particular limitation, and include, for example, dicarboxylic acid (DIC), polycarboxylic acid(TC) having 3 valences or more, and a mixture of dicarboxylic acid (DIC) and polycarboxylic acid having 3 valences or more. They may be used singly or in combination. Out of them, dicaboxylic acid (DIC) alone or a mixture of DIC and a small amount of polycarboxylic acid having 3 valences or more (TC) are preferable.

Examples of the dicarboxylic acids include alkylene dicarboxylic acids, alkenylene dicarboxylic acids, and aromatic dicarboxylic acids.

Examples of the alkylene dicarboxylic acids include succinic acid, adipic acid, and sebacic acid. The alkenylene dicarboxylic acids preferably have 4 to 20 carbon atoms, and examples include, for example, maleic acid and fumaric acid. The aromatic dicarboxylic acids preferably have 8 to 20 carbon atoms, and examples include, for example, phthalic acid, isophthalic acid, terephthalic acid, and naphthalene dicarboxylic acid.

Out of them, alkenylene dicarboxylic acids of carbon 4 to 20 carbon atoms, and aromatic dicarboxylic acids of 8 to 20 carbon atoms are preferable.

For the polycarboxylic acids (TO) having 3 valences or more those having 3 to 8 valences or more are preferable, and examples include, for example, aromatic polycarboxylic acids.

The aromatic polycarboxylic acids preferably have 9 to 20 carbon atoms, and examples include, for example, trimellitic acid and pyromellitic acid.

As the polycarboxylic acids (PC), it is also possible to use acid anhydrides or lower alkylester products that are selected from the dicarboxylic acids (DIC), the polycarboxylic acids having 3 valences or more (TC), and a mixture of the dicarboxylic acids (DIC) and the polycarboxylic acids having 3 valences or more. Examples of the lower alkylesters include methylester, ethylester, and isopropylester.

The mixing ratio (DIC:TC) between the dicarboxylic acid (DIC) and the polycarboxylic acid having 3 valences or more (TC) in the mixture of the dicarboxylic acid (DIC) and the polycarboxylic acid having 3 valences or more (TC), on a mass basis, may be suitably selected depending on the purpose without no particular limitation, and is preferably 100:0.01 to 100:10, more preferably 100:0.01 to 100:1.

Upon polycondensation reaction between the polyol (PO) and polycarblxylic acid (PC), the mixing ratio between them on a mass basis may be suitably selected depending on the purpose without particular limitation. For example, the mixing ratio ([OH]/[COOH]) between hydroxyl group [OH] in the polyol (PO) and carboxylic group [COOH] in the polycarboxylic acid (PC) on an equivalence basis is preferably 2/1 to 1/1, more preferably 1.5/1 to 1/1, still more preferably 1.3/1 to 1.02/1.

The content of the polyol (PO) in the isocyanate group-containing polyester prepolymer (A) may be suitably selected depending on the purpose without particular limitation, and is, for example, preferably 0.5% by mass to 40% by mass, more preferably 1% by mass to 30% by mass, still more preferably 2% by mass to 20% by mass.

When the content is less than 0.5% by mass, a hot offset resistance may be worse, and both a heat resistant preserving property and a low-temperature fixing property may be hard to achieve. When exceeding 40% by mass, a low-temperature fixing property may be worse.

The polyisocyanates (PIC) may be suitably selected depending on the purpose without particular limitation, and include, for example, aliphatic polyisocyanates, alicyclic polyisocyanates, aromatic diisocyanates, araliphatic diisocynates, isocyanurates, and blocked ones with phenol derivatives, oximes or caprolactams.

Examples of the aliphatic polyisocyanates include tetramethylene diisocyanate, hexamethylene diisocyanate, 2,6-diisocyanatomethyl caproate, octamethylene diisocyanate, decamethylene, diisocyanate, dodecamethylene diisocyanate, tetradecamethylene diisocyanate, trimethylhexane diisocyanate, and tetramethylhexane diisocyanate. Examples of the alicyclic polyisocyanates include isophorone diisocyanate, and cyclohexylmethane diisocyanate. Examples of the aromatic diisocyanates include tolylene diisocyanate, diphenylmethane diisocyanate, 1,5-naphthylene diisocyanate, diphenylene-4, 4'-diisocyanate, 4,4'-diisocyanate -3,3'-dimethyldiphenyl, 3-methyldiphenylmethane-4,4'-diisocyanate, diphenylether-44'-diisocyanate. Examples of the araliphatic diisocyanates include α,α,α',α'-tetramethylxylylene diisocyanate. Examples of the isocyanurates include tris-isocya isocyanatoalkyl-isocyanurate, and triisocyanatocycroalkyl-isocyanurate. They may be used alone, or two or more of them may be used in combination.

For the mixing ratio when the polyisocyanate (PIC) and the active hydrogen group-containing polyester resin (for example, a hydroxyl group-containing polyester resin) are reacted, normally a blend equivalence ratio ([NCO]/[OH]) between isocyantate groups [NCO] in this polyisocyanate (PIC) and hydroxyl groups [OH] in this hydroxyl group-containing polyester resin is preferably 5/1 to 1/1, more preferably 4/1 to 1.2/1, still more preferably 3/1 to 1.5/1.

When the isocyanate groups [NCO] exceed 5, a low-temperature fixing property may be worse. When it is less 1, an offset resistance may be worse.

The content of the polyisocyanate (PIC) in the isocyanate group-containing polyester prepolymer (A) may be suitably selected depending on the purpose without particular limitation, and, for example, is preferably 0.5% by mass to 40% by mass, more preferably 1% by mass to 30% by mass, still more preferably 2% by mass to 20% by mass.

When the content is less than 0.5% by mass, a hot offset resistance may be worse, and both a heat resistant preserving property and a low-temperature fixing property may be hard to achieve. When exceeding 40% by mass, a low-temperature fixing property may be worse.

The average number of isocyanate groups contained in one molecule of the isocyanate group-containing polyester prepolymer (A) is preferably 1 or more, more preferably 1.2 to 5, still more preferably 1.5 to 4.

When the average number of the isocyanate groups is less 1, the molecular weight of polyester resin (RMPE) modified with the urea-bond generating groups comes to be low, and thus a hot offset resistance may be worse.

The weight average molecular weight (Mw) of a polymer capable of being reacted with the active hydrogen group-containing compound, with a molecular weight distribution by GPC (gel permeation chromatography) of tetrahydrofuran (THF) soluble part, is preferably 1,000 to 30,000, more preferably 1,500 to 15,000. When this weight average molecular weight (Mw) is less than 1,000, a heat resistant preserving property may be worse. When exceeding 30,000, a low-temperature fixing property may be worse.

The measurement of molecular weight distribution by the gel permeation chromatography (GPC) may be conducted, for example, as follows.

That is, a column is equilibrated in a heat chamber at 40° C. At this temperature, tetrahydrofuran (THF) is allowed to flow at a flow rate of 1 ml per one minute as a column solvent. Then, 50 μl to 200 μl of a tetrahydrofuran sample solution of resin whose sample concentration has been adjusted to 0.05% by mass to 0.6% by mass is injected, and then measured. In measurement of molecular weights in the sample, a molecular weight distribution which the sample includes is calculated from the relationship between log values of calibration curve prepared with several kinds of mono-dispersed polystyrene standard samples, and count numbers. As standard polystyrene samples for the calibration curve preparation, preferably used are the ones whose molecular weights are $6\times10^2$, $2.1\times10^2$, $4\times10^2$, $1.75\times10^4$, $1.1\times10^5$, $3.9\times10^5$, $8.6\times10^5$, $2\times10^6$, and $4.48\times10^6$, manufactured by Pressure Chemical Co. or Toyo Soda Industry Co., Ltd. At least about ten standard polystyrene samples are preferably used. Further, as the detector, RI (refraction) detector may be used.

—Binder Resin—

The binder resins may be suitably selected depending on the purpose without particular limitation, and include, for example, polyester resins. In particular, unmodified polyester resins (polyester resin not modified) are preferred.

When there is included in the toner the unmodified polyester resin, it is possible to improve a low-temperature fixing property and glossiness.

The unmodified polyester resins include the same ones as the urea bond generating group-containing polyester resin, that is a polycondensate of polyol (PO) and polycarboxylic acid (PC). This unmodified polyester resin is preferably compatible with the urea bond generating group-containing polyester resin (RMPE) at a part thereof, that is, they are in the similar structure compatible with each other in respect of a low-temperature fixing property and a hot offset resistance.

The weight average molecular weight (Mw) of the unmodified polyester resin, in the molecular weight distribution by GPC (gel permeation chromatography) of a tetrahydrofuran (THF) soluble part, is preferably 1,000 to 30,000, more preferably 1,500 to 15,000. When the weight average molecular weight (Mw) is less than 1,000, a thermal stability may be reduced. Thus, the content of components the weight average molecular weight (Mw) of which are less than 1,000 needs to be 8% by mass to 28% by mass, as described above. On the other hand, when the weight average molecular weight (Mw) exceeds 30,000, a low temperature fixing property may be worse.

The glass transition temperature of the unmodified polyester resin is normally 30° C. to 70° C., more preferably 35° C. to 70° C., still more preferably 35° C. to 50° C., particularly preferably 35° C. to 45° C. When the glass transition temperature is less than 30° C., a heat resistant preserving property of toner may be worse. When exceeding 70° C., a low temperature fixing property may be insufficient.

The hydroxyl value of the unmodified polyester resin is preferably 5 mgKOH/g or more, more preferably 10 mgKOH/g to 120 mgKOH/g, still more preferably 20 mgKOH/g to 80 mgKOH/g. When the hydroxyl value is less than 5 mgKOH/g, both a heat resistant preserving property and a low-temperature fixing property may be hard to achieve.

The acid value of the unmodified polyester resin is preferably 1.0 mgKOH/g to 50.0 mgKOH/g, more preferably 1.0 mgKOH/g to 45.0 mgKOH/g, still more preferably 15.0 mgKOH/g to 45.0 mgKOH/g. In general, by causing the toner to have acid values, toner is more likely to be of negative chargeability.

In the case where the toner materials contain the unmodified polyester resins, the mixing ratio (polymer/unmodified polyester resin) between a polymer capable of being reacted with an active hydrogen group-containing compound (for example, an urea bond generating group-containing polyester resin) and this unmodified polyester resin on a mass basis is preferably 5/95 to 80/20, more preferably 10/90 to 25/75. When a blend mass ratio of the unmodified polyester resin (PE) exceeds 95, a hot offset resistance may be worse, and both a heat resistant preserving property and a low-temperature fixing property may be hard to achieve. When it is less than 20, glossiness may be worse.

The content of the unmodified polyester resin in the binder resin, for example, is preferably 50% by mass to 100% by mass, more preferably 70% by mass to 95% by mass, still more preferably 80% by mass to 90% by mass. When the content is less than 50% by mass, a low-temperature fixing property or glossiness of images may be worse.

—Colorant—

The colorants may be suitably selected depending on the purpose from known dyes and pigments without particular limitation, and include, for example, carbon black, Nigrosine dyes, black iron, Naphthol Yellow S, Hansa Yellow (10G, 5G and G), Cadmium Yellow, yellow iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Fire Red, p-chloro-o-nitroaniline red, LitholFast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emeraldegreen, Pigment Green B, Naphthol Green B, Green Gold, Acidegreen Lake, Malachite Green Lake, Phthalocyanine Green, Anthraquinone Green, titanium oxide, zinc oxide, and lithopone. These colorants may be used singly or in combination.

The content of the colorants in the toner may be suitably selected depending on the purpose without particular limitation, and is preferably 1% by mass to 15% by mass, more preferably 3% by mass to 10% by mass. When the content is less than 1% by mass, the coloring power of toner is shown to decrease. When exceeding 15% by mass, dispersion defects of pigments occur in toner, and the reduction in coloring power, and the decrease in electrical properties of toner may be induced.

The colorants may be used as a master batch that is combined with resin. The resin may be suitably selected from known ones depending on the purpose without particular limitation. Examples of the colorants include styrene or substituted polymers thereof, styrene copolymers, polymethyl methacrylate, polybutylmethacrylate, polyvinyl chloride, polyvinyl acetate, polyethylene, polypropylene, polyesters, epoxy resins, epoxy polyol resins, polyurethane resins, polyamide resins, polyvinyl butyral resins, polyacrylic resins, rosin, modified rosins, terpene resins, aliphatic or alicyclic hydrocarbon resins, aromatic petroleum resins, chlorinated paraffin, and paraffin. These resins may be used singly or in combination.

Examples of the styrene or polymers of substitutes thereof include polyester resin, polystyrene, poly-p-chlorostyrene, and polyvinyltoluene. Examples of the styrene copolymers include styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers.

The master batch can be manufactured by mixing and kneading the master batch resin and the colorant under large shearing force. In this process, to enhance interaction between colorants and resins, an organic solvent is preferably added. Furthermore, the so-called flushing method is preferred in that a wet cake of colorants can be used as it is, and no drying is needed. In this flushing method, an aqueous paste containing colorants is mixed and kneaded with resins and organic solvents, and the colorants are made to transfer to the resin side to remove water and organic solvent components. In the mixing and kneading, a high shearing dispersion apparatus, for example, a three-roll mill is preferably used.

—Other Components—

The other components may be suitably selected depending on the purpose without particular limitation, and include, for example, a releasing agent, inorganic fine particles, a flowability improver, a cleanability improver, magnetic materials, and a metal soap.

The releasing agents may be suitably selected from known ones depending on the purpose without particular limitation; preferable examples include waxes.

The waxes include, for example, carbonyl group-containing waxes, polyolefin waxes, and long chain hydrocarbons. They may be used alone, or two or more of them may be used in combination. Out of them, carbonyl group-containing waxes are preferred.

Examples of the carbonyl group-containing waxes include polyalkanoic acid esters, polyalkanol esters, polyalkanoic acid amide, polyalkylamide, and dialkyl ketone. Examples of the polyalkanoic acid esters include carnauba wax, montan wax, trimethylolpropane tribehenate, pentaerythritol tetrabehenate, pentaerythritol diacetate dibehenate, glycerintribehenate, and 1,18-octadecanediol distearate. Examples of the polyalkanol esters include trimellitic acid tristearyl, and distearyl maleate. Examples of the polyalkanoic acid amides include dibehenyl amide. Examples of the polyalkylamides incldue trimellitic acid tristearylamide. Examples of the dialkyl ketones include distearyl ketone. In these carbonyl group-containing waxes, polyalkanoic acid esters are particularly preferred.

Examples of the polyolefin waxes include polyethylene wax and polypropylene wax.

Examples of the long chain hydrocarbons include paraffin wax and xazole wax.

The melting point of the releasing agents may be suitably selected depending on the purpose without particular limitation, and is preferably 40° C. to 160° C., more preferably 50° C. to 120° C., still more preferably 60° C. to 90° C.

When the melting point is less than 40° C., wax may adversely affect a heat resistant preserving property. When it exceeds 160° C., cold offset is likely to occur at the time of fixing at low temperature.

The melting viscosity of the releasing agents, as measured values at temperatures higher than a melting point of these waxes by 20° C., is preferably 5 cps to 1,00 cps, more preferably 10 cps to 100 cps.

When the melting viscosity is less than 5 cps, a releasing property may be reduced. When it exceeds 1,000 cps, improvement effects on a hot offset resistance and a low-temperature fixing property may not be obtained.

The content of the releasing agent in the toner may be suitably selected on the purpose without particular limitation, and is preferably 0% by mass to 40% by mass, more preferably 3% by mass to 30% by mass.

When the content exceeds 40% by mass, the toner flowability may be reduced.

—Resin Fine Particles—

The resin fine particles may be suitably selected depending on the purpose from known resins insofar as they are resins capable of forming an aqueous dispersion in an aqueous medium. The resin fine particles may be thermoplastic resin or thermosetting resin, and examples include, for example, vinyl resins, polyurethane resins, epoxy resins, polyester resins, polyamide resins, polyimide resins, silicon resins, phenol resins, melamine resins, urea resins, aniline resins, ionomer resins, and polycarbonate resins. They may be used singly or in combination. Out of them, in view of the fact that an aqueous dispersion of resin fine particles of fine spherical shapes are easy to obtain, it is preferable that resin fine particles are made of at least one resin selected from vinyl resins, polyurethane resins, epoxy resins and polyester resins.

Moreover, the vinyl resins are a polymer obtained by a single polymerization or copolymerization of vinyl monomers, and examples include, for example, styrene-(metha) acryl ester resins, styrene-butadiene co-polymers, (metha) acrylic acid-acryl ester copolymers, styrene-acrylonitrile copolymers, styrene-maleic anhydride copolymers, and styrene-(metha) acrylic acid copolymers.

Further, as the resin fine particles, a copolymer containing a monomer including at least two unsaturated groups may be used as well.

The monomers having at least two unsaturated groups may be suitably selected depending on the purpose without particular limitation, and include, for example, sodium salts of sulfate ester of methacrylic acid ethylene oxide adduct (Eleminol RS-30, manufactured by Sanyo Chemical Industries Ltd.), divinyl benzene, and 1,6-hexane diol acrylate.

The resin fine particles may be obtained by polymerization according to the known method suitably selected depending on the purpose, and is preferably obtained as an aqueous dispersion of these resin fine particles. Preparation methods of an aqueous dispersion of these resin fine particles preferably include, for example, (1) method in which in the case of the vinyl resin, an aqueous dispersion of resin fine particles is directly manufactured by any polymerization reaction selected from suspension polymerization method, emulsification polymerization method, seed polymerization method, and dispersion polymerization method with vinyl monomer a starting material, (2) method in which in the polyaddition or condensation resins such as the polyester resin, polyurethane resin, and epoxy resin, precursors (monomer, oligomer and the like) or a solvent solution thereof is dispersed in an aqueous medium in the presence of a suitable dispersant, and thereafter heated or added with a curing agent to be cured, to manufacture an aqueous dispersion of resin fine particles (3) method in which in the polyaddition or condensation resins such as the polyester resin, polyurethane resin, and epoxy resin, a suitable emulsifying agent is dissolved in precursors (monomer, oligomer and the like) or a solvent solution thereof (liquid is preferred. It may be liquefied by heating), and thereafter water is added to be phase-inverted and emulsified (4) method in which resin having been preliminarily prepared by polymerization reaction (may be any polymerization reaction method of addition polymerization, ring-opening polymerization, polyaddition, addition condensation, and condensation polymerization) is milled using pulverizing mills of mechanical rotation-type or jet-type and subsequently classified to obtain resin fine particles, and thereafter dispersed in water in the presence of a suitable dispersant (5) method in which a resin solution in which resin having been preliminarily prepared by polymerization reaction (may be any polymerization reaction method of addition polymerization, ring-opening polymerization, polyaddition, addition condensation, and condensation polymerization) is dissolved in a solvent is sprayed in atomization state to obtain resin fine particles, and thereafter these resin fine particles are dispersed in water in the presence of a suitable dispersant (6) method in which resin fine particles are precipitated by adding a lean solvent to a resin solution in which resin having been preliminarily prepared by polymerization reaction (may be any polymerization reaction method of addition polymerization, ring-opening polymerization, polyaddition, addition condensation, and condensation polymerization) is dissolved into a solvent, or cooling a resin solution in which this resin has been preliminarily heated and dissolved, then the solvent is removed to obtain resin fine particles, and thereafter these resin fine particles are dispersed in water in the presence of a suitable dispersant (7) method in which a resin solution in which resin having been preliminarily prepared by polymerization reaction (may be any polymerization reaction method of addition polymerization, ring-opening polymerization, polyaddition, addition condensation, and condensation polymerization) is dissolved into a solvent, is dispersed in an aqueous medium in the presence of a suitable dispersant, and thereafter a solvent is removed by e.g., heating or depressurizing (8) method in which a suitable emulsification agent is dissolved in a resin solution in which resin having been preliminarily prepared by polymerization reaction (may be any polymerization reaction method of addition polymerization, ring-opening polymerization, polyaddition, addition condensation, and condensation polymerization) is dissolved into a solvent, and thereafter water is added to be phase-inverted and emulsified.

Examples of the foregoing toner include those produced by known methods such as suspension polymerization method, emulsification coagulation method, and emulsification dispersion method. A preferable example is a toner obtained by dissolving in an organic solvent a toner material containing active hydrogen group-containing compound and a polymer capable of being reacted with this active hydrogen group-containing compound to prepare a toner solution, thereafter dispersing this toner solution in an aqueous medium to prepare a dispersion, causing the active hydrogen group-containing compound and a polymer capable of being reacted with the active hydrogen group-containing compound to react to generate an adhesive base material in particulates, and removing the organic solvent.

—Toner Solution—

The toner solution is prepared by dissolving the toner materials into the organic solvent.

—Organic Solvent—

The organic solvents may be suitably selected depending on the purpose without particular limitation insofar as they are solvents capable of dissolving or dispersing the toner materials, and preferably the ones which are volatile with a boiling point less than 150° C. because they can be removed readily. Examples of the organic solvents include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. These solvents may be used alone, or two or more of them may be used in combination. Among these solvents, toluene, xylene, benzene, methylene chloride, 1,2-dichloroethane, chloroform, carbon tetrachloride and the like are preferred. Ethyl acetate is particularly preferred.

The used amount of the organic solvents may be selected depending on the purpose without particular limitation, and is preferably, for example, 40 parts by mass to 300 parts by mass, more preferably 60 parts by mass to 140 parts by mass, still more preferably 80 parts by mass to 120 parts by mass per 100 parts by mass of the toner materials.

—Dispersion—

The dispersion is prepared by dispersing the toner solution in an aqueous medium.

When the toner solution is dispersed in the aqueous medium, a dispersion (oil droplets) formed of the toner solution is formed in this aqueous medium.

—Aqueous Medium—

The aqueous medium may be suitably selected from known ones without particular limitation, and examples include, for example, water, a solvent mixable with water, and a mixture thereof. Out of them, water is particularly preferred.

Solvents mixable with the water are not particularly limited insofar as they are mixable with the water, and include, for example, alcohol, dimethyl formamide, tetrahydrofuran, cellusolves, and lower ketones.

The alcohols include, for example, methanol, isopropanol, and ethylene glycol. The lower ketones include, for example, acetone, and methyl-ethyl-ketone. They may be used alone, or two or more of them may be used in combination.

The toner solution is preferably dispersed under stirring in the aqueous medium.

Methods of the dispersion may be suitably selected using known dispersers without particular limitation. Examples of these dispersers include a low-speed shearing disperser, a high-speed shearing disperser, a friction disperser, a high-pressure jet disperser, and an ultrasonic disperser. Out of them, in that particle sizes of the dispersion (oil droplets) can be controlled to be 2 μm to 20 μm, a high-speed shearing disperser is preferred.

In the case of using the high-speed shearing disperser, conditions such as the number of revolutions, a dispersion time period, and dispersing temperature may be suitably selected depending on the purpose without particular limitation. For example, the number of revolutions is preferably 1,000 rpm to 30,000 rpm, more preferably 5,000 rpm to 20,000 rpm. The dispersion time period is preferably 0.1 minutes to 5 minutes in the case of batch method. The dispersing temperature is preferably 0° C. to 150° C., more preferably 40° C. to 98° C. under pressure. In addition, the higher the dispersing temperature is, generally the easier dispersing is.

As an example of the manufacturing method of the toner, the method in which the adhesive base material is produced in particulates will be described below.

In the method of producing the adhesive base material in particulates to granulate toner, for example, made are preparation of an aqueous medium phase, preparation of the toner solution, preparation of the dispersion, addition of the aqueous medium, and others (synthesis of a polymer capable of being reacted with the active hydrogen group-containing compound (prepolymer), synthesis of the active hydrogen group-containing compound, and the like).

Preparation of the aqueous medium phase may be made by, for example, dispersing the resin fine particles in the aqueous medium. The addition amount of these resin fine particles in this aqueous medium may be suitably selected depending on the purpose without particular limitation, and is preferably 0.5% by mass to 10% by mass.

Preparation of the toner solution may be made by dissolving or dispersing in the organic solvent toner materials such as the active hydrogen group-containing compound, the polymer capable of being reacted with the active hydrogen group-containing compound, the colorant, the releasing agent, the charge control agent, and the unmodified polyester resin. Furthermore, to form an inorganic oxide particle-containing layer within 1 μm from the toner surface, inorganic oxide particles such as silica, titania, and alumina are added.

Moreover, out of the toner materials, components other than polymer (prepolymer) capable of being reacted with the active hydrogen group-containing compound, in the aqueous medium phase preparation, may be added and mixed in this aqueous medium when the resin fine particles are dispersed in the aqueous medium, or may be added to the aqueous medium phase along with this toner solution when the toner solution is added to the aqueous medium phase.

The dispersion may be prepared by emulsifying and dispersing the toner solution having been preliminarily prepared in the aqueous medium phase having been preliminarily prepared. Further, in these emulsification and dispersing, the active hydrogen group-containing compound and the polymer capable of being reacted with the active hydrogen group-containing compound are brought in extension reaction or cross-linking reaction, and thus the adhesive base material is produced.

The adhesive base material (for example, the urea modified polyester resin) may be produced by the following methods. These methods are; (1) method in which the toner solution containing the polymer capable of being reacted with the active hydrogen group-containing compound (for example, the isocyanate group-containing polyester prepolymer (A)) is emulsified or dispersed in the aqueous medium phase along with the active hydrogen group-containing compound (for example, the amines (B)), a dispersion is formed, and both are brought in extension reaction or cross-linking reaction in this aqueous medium phase; (2) method in which the toner solution is emulsified or dispersed in the aqueous medium to which the active hydrogen group-containing compound has been preliminarily added, a dispersion is formed, and both are brought in extension reaction or cross-linking reaction in this aqueous medium phase; and (3) method in which the toner solution is added to and mixed with the aqueous medium, thereafter the active hydrogen group-containing compound is added, a dispersion is formed, and both of them are brought in extension reaction and cross-linking reaction at the interface of particles in this aqueous medium phase. Furthermore, in the case of the (3), a modified polyester resin is preferentially produced on the surface of toner to be prepared, and a concentration gradient may also be provided in this toner particle.

As reaction conditions for producing the adhesive base materials by the emulsification and dispersion are not particularly limited, but may be suitably selected based on the combinations between a polymer capable of being reacted with the active hydrogen group-containing compound and the active hydrogen group-containing compound. A reaction time period is preferably 10 minutes to 40 hours, more preferably 2 hours to 24 hours. A reaction temperature is preferably 0° C. to 150° C., more preferably 40° C. to 98° C.

Methods of stably forming the dispersion containing a polymer capable of being reacted with the active hydrogen group-containing compound (for example, the isocyanate group-containing polyester prepolymer (A)), include, for example, the method in which a toner solution prepared by causing the toner materials such as a polymer capable of being reacted with the active hydrogen group-containing compound (for example, the isocyanate group-containing polyester prepolymer (A)), the colorant, the releasing agent, the charge control agent, and the unmodified polyester resin, to be dissolved or dispersed in the organic solvent, is added and dispersed by a shearing force. In addition, details of the dispersing method are as described above.

Upon preparation of the dispersion, when necessary, from the standpoint of causing the dispersion (oil droplets formed of the toner solution) to be stable and of making a particle size distribution sharp while obtaining desired shapes, a dispersant is preferred to be used.

The dispersants may be suitably selected depending on the purpose without particular limitation, and include, for example, a surfactant, an inorganic compound dispersant of water insolubility, and high-molecular protective colloid. They may be used singly or in combination. Out of them, surfactants are preferred.

The surfactants include, for example, anionic surfactants, cationic surfactants, non-ionic surfactants, and ampholytic surfactants.

Examples of the anionic surfactants include alkylbenzene sulfonate, α-olefin sulfonate, and phosphate, preferably a surfactant having a fluoroalkyl group. Examples of anionic surfactants having this fluoroalkyl group include fluoroalkyl carboxylic acids having from 2 to 10 carbon atoms or metal salts thereof, disodium perfluorooctanesulfonyl glutamate, sodium 3-{omega-fluoroalkyl(C6-C11)oxy}-1-alkyl(C3-C4) sulfonate, sodium 3-{omega-fluoroalkanoyl(C6-C8)-N-ethylamino}-1-propanesulfonate, fluoroalkyl(C11-C20) carboxylic acids and metal salts thereof, perfluoroalkylcarboxylic acids and metal salts thereof, perfluoroalkyl(C4-C12)sulfonate and metal salts thereof, perfluorooctanesulfonic acid diethanol amides, N-propyl-N-(2-hydroxyethyl-)perfluorooctanesulfone amide, perfluoroalkyl (C6-C10)sulfoneamidepropyltri-methylammonium salts, perfluoroalkyl (C6-C10)-N-ethylsulfonyl glycin salts, and monoperfluoroalkyl(C6-C16)ethylphosphates. Examples of commercially available products of surfactants containing this fluoroalkyl group include SURFLON S-111, S-112 and S-113, manufactured by Asahi Glass Co., Ltd.; FRORARD FC-93, FC-95, FC-98 and FC-129, manufactured by Sumitomo 3M Ltd.; UNIDYNE DS-101 and DS-102, manufactured by Daikin Industries, Ltd.; MEGAFACE F-110, F-120, F-113, F-191, F-812 and F-833, manufactured by Dainippon Ink and Chemicals, Inc.; ECTOP EF-102, 103, 104, 105, 112, 123A, 306A, 501, 201 and 204, manufactured by Tohchem Products Co., Ltd.; and FUTARGENT F-100 and F150 manufactured by Neos.

Examples of the cationic surfactants include amine salt-type surfactants and cationic surfactants of quaternary ammonium salt-type. Examples of the amine salt-type surfactants include alkyl amine salts, aminoalcohol fatty acid derivatives, polyamine fatty acid derivatives and imidazoline. Examples of cationic surfactants of the quaternary ammonium salt-type include alkyltrimethyl ammonium salts, dialkyldimethyl ammonium salts, alkyldimethyl benzyl ammonium salts, pyridinium salts, alkyl isoquinolinium salts and benzethonium chloride. These cationic surfactants include primary, secondary and tertiary aliphatic amino acids having a fluoroalkyl group, aliphatic quaternary ammonium salts such as perfluoroalkyl(C6-C10)sulfoneamidepropyltrimethylammonium salts, benzalkonium salts, benzetonium chloride, pyridinium salts, and imidazolinium salts. Examples of commercially available products of these cationic surfactants include SURFLON S-121 (from Asahi Glass Co., Ltd.); FRORARD FC-135 (from Sumitomo 3M Ltd.); UNIDYNE DS-202 (from Daikin Industries, Ltd.); MEGAFACE F-150 and F-824 (from Dainippon Ink and Chemicals, Inc.);

ECTOP EF-132 (from Tohchem Products Co., Ltd.); and FUTARGENT F-300 (from Neos).

Examples of non-ionic surfactants include fatty acid amide derivatives and polyhydric alcohol derivatives.

Examples of the ampholytic surfactants include alanine, dodecyldi(aminoethyl)glycin, di(octylaminoethyle) glycin, and N-alkyl-N,N-dimethylammonium betaine.

Examples of the inorganic compound dispersants of water insolubility include tricalcium phosphate, calcium carbonate, titanium oxide, colloidal silica, and hydroxyapatite.

Examples of the polymeric protection colloids include acids, (metha)acrylic monomers containing acids hydroxyl groups, vinyl alcohol or ethers of vinyl alcohol, esters of vinyl alcohol with a compound having a carboxyl group, amide compounds or methylol compounds thereof, chlorides, homopolymers or copolymers such as those containing nitrogen atoms or heterocycles thereof, polyoxyethylenes, and celluloses.

Examples of the acids include acrylic acid, methacrylic acid, α-cyanoacrylic acid, α-cyanomethacrylic acid, itaconic acid, crotonic acid, fumaric acid, maleic acid and maleic anhydride. Examples of the (metha)acrylic monomers having the hydroxyl group include β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacry-lic acid esters, diethyleneglycolmonomethacrylic acid esters, glycerinmonoacrylic acid esters, glycerinmonomethacrylic acid esters N-methylolacrylamide and N-methylolmethacrylamide. Examples of the vinyl alcohol and ethers of vinyl alcohol include vinyl methyl ether, vinyl ethyl ether and vinyl propyl ether. Examples of the esters of vinyl alcohol with a compound having a carboxyl group include vinyl acetate, vinyl propionate and vinyl butyrate. Examples of the amide compounds or methylol compounds thereof include acrylamide, methacrylamide and diacetoneacrylamide or methylol compounds thereof. Examples of the chlorides include acrylic acid chloride and methacrylic acid chloride. Examples of the homopolymers or copolymers such as contain the nitrogen atoms or heterocycles thereof include vinyl pyridine, vinyl pyrrolidone, vinyl imidazole and ethylene imine. Examples of the polyoxyethylenes include polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters. Examples of the celluloses include methyl cellulose, hydroxyethyl cellulose and hydroxypropyl cellulose.

In preparation of the dispersion, a dispersion stabilizer may be used as necessary.

The dispersion stabilizers include, for example, the ones which are soluble in acid and alkali, such as calcium phosphate.

In the case of using this dispersion stabilizer, calcium phosphate can be removed by a method in which calcium phosphate is dissolved in an acid such as hydrochloric acid and washed with water, or a method of being decomposed with enzymes.

In preparation of the dispersion, catalysts in the extension reaction or the cross-linking reaction may be used. These catalysts include, for example, dibutyltin laurate and dioctyltin laurate.

An organic solvent is removed from a dispersion (emulsified slurry) having been obtained. This organic solvent is removed by the method (1) in which the whole reaction system is warmed by degrees to completely evaporate and remove the organic solvent in the oil droplets, and the method (2) in which an emulsified dispersion is atomized in a dry atmosphere, and an insoluble organic solvent in oil droplets is completely removed to form toner fine particles, as well as an aqueous dispersant is evaporated and removed.

When the organic solvent is removed, toner particles are formed. With respect to these toner particles, washing and drying can be made, and thereafter classification can further be made as desired. This classification is conducted in a liquid by removing fine particle parts with cyclone, decanter, and a centrifugal separator. The classification operation may be made after having been obtained as powders after drying.

Toner particles having been obtained like this are mixed along with particles of the colorant, releasing agent, and the charge control agent, or further is applied with a mechanical impact, thereby making it possible to prevent particles of this releasing agent and the like from coming off from the surface of this toner particle.

As methods of applying the mechanical impact include, for example, the method of applying an impact to a mixture by vanes in rotation at high speed, and the method in which the mixture is put in a high-speed air current to be accelerated, and particles are collided with each other or particles having been complex are made to collide to a suitable collision plate. Apparatuses for use in these methods include, for example, an angmill (manufactured by Hosokawa Micron Corporation), a modified I-type mill (manufactured by Nippon Pneumatic MFG., Co., Ltd.), which is reconstructed in reduced pulverizing air pressure, a hybridization system (manufactured by Nara Machine Corporation), Kryptron System (manufactured by Kawasaki Heavy Industries, Ltd.), and an automatic mortar.

The toner is preferred to include the following volume average particle diameter (Dv), volume average particle diameter (Dv)/number average particle diameter (Dn), average circularity, and shape factors SF-1 and SF-2.

The volume average particle diameter of the toner is preferably 3 μm to 8 μm, more preferably 4 μm to 7 μm, still more preferably 5 μm to 6 μm. Herein, a volume average particle diameter is defined as $Dv=[(\Sigma(nD^3)/\Sigma n)^{1/3}$ (where: n is a particle number, and D is a particle diameter).

When the volume average particle diameter is less than 3 μm, in a two component developer, toner is fused onto the surface of a carrier under stirring for a long time period in a developing unit, and thus a chargeability of the carrier may be decreased; and in one-component developer, since filming of toner onto a developing roller is made, or toner is made in a thinner layer, the fusion of toner onto members such as blades is likely to occur. When exceeding 8 μm, images of high resolution and high image quality becomes hard to obtain. Further, in the case of toner balance in a developer being conducted, the variation of particle sizes of toner may be larger.

The ratio (Dv/Dn) of volume average particle diameter (Dv) to number average particle diameter (Dn) is preferably 1.00 to 1.40, more preferably 1.00 to 1.25, still more preferably 1.00 to 1.20, further still more preferably 1.10 to 1.20.

When the ratio (Dv/Dn) is 1.40 or less, the particle size distribution of the toner is comparatively sharp, and fixing property is improved. When, however, it is less 1.00, in a two component developer, toner is fused onto the surface of a carrier under stirring for a long time period in a developing unit, and thus a chargeability of the carrier may be decreased or a cleaning property may be worse; and in one-component developer, since filming of toner onto a developing roller is made, or toner is made in a thinner layer, the fusion of toner onto members such as blades is likely to occur. When exceeding 1.40, images of high resolution and high image quality become hard to obtain. Further, in the case of toner balance in a developer being conducted, the variation of particle sized of toner may be larger.

The ratio (Dv/Dn) of volume average particle diameter the number average particle diameter may be measured using a particle size analyzer ("Multi-Sizer", manufactured by Beckman Coulter Electronics, Inc.).

The average circularity is a value obtained by dividing a perimeter of an equivalent circle which project area is equal to the shape of the toner by the perimeter of an actual particle, and is preferably, for example, 0.94 to 0.97.

When the average circularity is less than 0.94, toner comes to be irregularly shaped apart from a spherical shape, and thus no high-quality images having a sufficient transfer property and with no dusts may be obtained. When exceeding 0.97, in an image forming system adopting blade cleaning, cleaning defects on a photoconductor, a transfer belt and the like occurs, and thus the following dirt on images will be generated. For example, in the case of forming images of high image area ratio such as photographic images, background smear of images may occur due to that toner having formed non-transferred images is accumulated as residual transfer toner on the photoconductor owing to e.g,. paper feed defect. Further, this toner contaminates a charging roller functioning to be in contact to charge the photoconductor, and thus an original electrostatic chargeability may not be exhibited.

The average circularity can be measured, for example, by the method of an optical detection band in which a suspension containing toner is passed through an image detection band on a flat plate, and particle images are optically detected with a CCD camera and analyzed. Measurement is made with the use of a flow-type particle image analyzer FPIA-2100 (manufactured by Sysmex Corporation).

Figure 4:
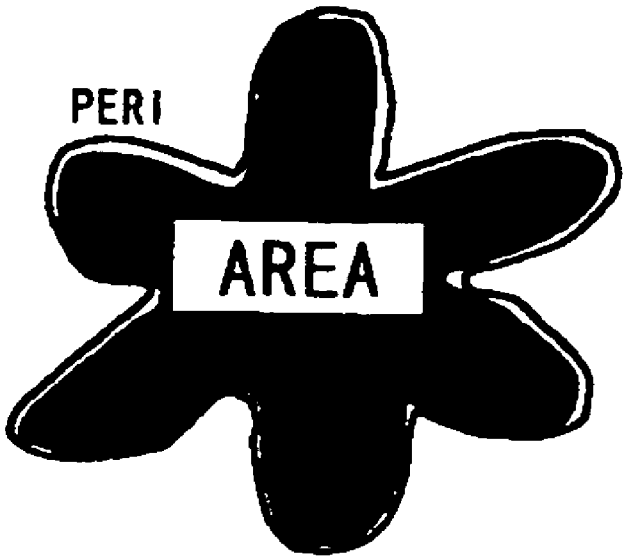
FIG. 4 is a view schematically showing the shape of toner for explaining a shape factor SF-1.

FIG. 4 is a schematic view of a toner shape for explaining a shape factor SF-1. A substantially spherical shape in the toner is shown with a shape factor SF-1 indicating degrees of a spherical shape (circularity) of toner expressed with the following equation 1. This shape factor SF-1 is a value obtained by dividing squared maximum length MXLNG of a shape to be formed by projecting toner on a two-dimensional plane by a shape area AREA and by multiplying by 100Π/4.

$$SF\text{-}1=(MXLNG)^2/AREA\times\Pi/4\times100 \qquad \text{equation 1}$$

where MXLNG represents the maximum length across a two-dimensional projection of a toner particle, and AREA represents the area of the projection The shape factor SF-1 is preferably 110 to 140. In the case where the SF-1 is 100, the shape of toner comes to be a completely spherical shape. As values of SF-1 are increased, toner becomes irregularly shaped. When the SF-1 exceeds 140, although a cleaning property is improved, since it is largely deviated from a spherical shape, an electrostatic charge density distribution is wider, there is much fogging, and thus an image quality is decreased.

Figure 5:
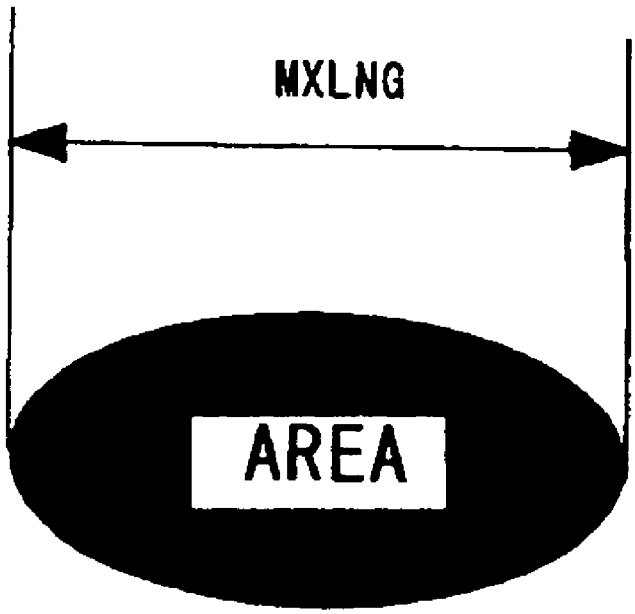
FIG. 5 is a view schematically showing the shape of toner for explaining a shape factor SF-2.

FIG. 5 is a schematic view of a toner shape for explaining a shape factor SF-2. Degrees of concavo-concavities of the toner is shown with a shape factor SF-2 represented by the following equation 2. This shape factor SF-2 is a value obtained by dividing the squared perimeter PERI to be formed by projecting toner on a two-dimensional plane by a shape area AREA and multiplying by 100Π/4.

$$SF\text{-}2=(PERI)^2/AREA\times\tfrac{1}{4}\Pi\times100 \qquad \text{equation 2}$$

where PERI represents the perimeter of a two-dimensional projection of a toner particle, and AREA represents the area of the projection The SF-2 is preferably 120 to 160. In the case where the SF-2 is 100, it means that there are no convex-concavities on the toner surface. As the SF-2 is increased, convex-concavities on the toner surface come to be more marked. When values of the SF-2 exceed 160, although a cleaning property is improved, concavo-concavities on the toner surface become larger, an electrostatic charge density distribution is wider, there is much fogging, and thus an image quality is decreased.

Herein, the shape factors SF-1 and SF-2 are obtained by the method in which, for example, toner is photographed with a scanning electron microscope (S-800, manufactured by Hitachi), this is introduced into an image analyzer analyzer (LUSEX3, manufactured by Nicore), analyzed, and calculated using the foregoing equations 1 and 2.

Coloring of the toner may be suitably selected depending on the purpose without particular limitation, and may be at least one kind toner to be selected from black toner, cyan toner, magenta toner, and yellow toner. Although each color of toner can be obtained by suitably selecting kinds of the colorants, color toners are preferred.

(Developer)

A developer for use in the present invention at least contains the toner, and contains other components suitably selected such as carrier. This developer may be one-component developer, or a two component developer. In the case of being used in e.g., high-speed printers that meet the needs of higher information processing speed in recent years, the two component developer is preferred in terms of long life.

In the case of the one-component developer using the toner, even if the balance of toner is conducted, the variation of particle sizes of toner is small, there is no filming of toner onto a developing roller or no fusion of toner onto members such as blades for making toner in a thinner layer, and thus an excellent and stable developability and images can be obtained even if a developing unit is used (under stirring) for a long time period. Moreover, in the case of the two component developer using the toner, even if the balance of toner over a long time period is conducted, the variation of toner particle sizes in a developer is small, and an excellent and stable developability can be obtained even if a developing unit is used under stirring for a long time period.

The carriers may be suitably selected depending on the purpose without particular limitation, and preferably includes a core member and a resin layer covering this core member.

Materials of the core member may be suitably selected from known ones without particular limitation, and are preferably, for example, 50 emu/g to 90 emu/g of manganese-strontium (Mn—Sr) material and manganese-magnesium (Mn—Mg) material. Further, materials of the core member are preferably high-magnetic materials such as iron powder (100 emu/g or more) and magnetite (75 emu/g to 120 emu/g) in respect of highly reliable image densities. Furthermore, materials of the core members are preferably low-magnetic materials such as copper-zinc (Cu—Zn) materials (30 emu/g to 80 emu/g) in respect of smaller collision to a photoconductor where toner is in the napping state, and being advantageous in higher image quality. They may be used alone, or two or more of them may be used in combination.

A particle diameter of the core member is preferably 10 μm to 200 μm, more preferably 40 μm to 100 μm in terms of the average particle size (volume average particle diameter ($D_{50}$)).

When the average particle size (volume average particle diameter ($D_{50}$)) is less 10 μm, there are much fine powders in distribution of carrier particles, a magnetization per one particle comes to be lower, and thus the splash of carrier may occur. When exceeding 200 μm, a specific surface area is decreased, and thus the splash of toner may occur. In full-color having much solids, particularly reproduction of solid parts may be worse.

Materials of the resin layer may be suitably selected depending on the purpose from known resins without particular limitation, and include, for example, amino resins, polyvinyl resins, polystyrene resins, halogenated olefin resins, polyester resins, polycarbonate resins, polyethylene resins, polyvinyl fluoride resins, polyvinylidene fluoride resins, polytrifluoroethylene resins, polyhexafluoropropylene resins, copolymers of vinylidenefluoride and acrylic monomer, copolymers of vinylidenefluoride and vinylfluoride, fluoroterpolymers such as terpolymers of tetrafluoroethylene, vinylidenefluoride and non-fluoride monomers, and silicone resins. They may be used alone, or two or more of them may be used in combination.

Examples of the amino resins include urea-formaldehyde resins, melamine resins, benzoguanamine resins, urea resins, polyamide resins, and epoxy resins. Examples of the polyvinyl resins include acrylic resins, polymethylmethacrylate resins, polyacrylonitirile resins, polyvinyl acetate resins, polyvinyl alcohol resins, polyvinyl butyral resins. Examples of the polystyrene resins include polystyrene resins and styrene-acrylic copolymer resins. Examples of the halogenated olefin resins include polyvinyl chloride resins. Examples of the polyester resins include polyethyleneterephthalate resins and polybutyleneterephthalate resins.

The resin layer may contain conductive powders as necessary. These conductive powders include, for example, metal powders, carbon black, titanium oxide, tin oxide, and zinc oxide. These conductive powders are preferably 1 μm or less in an average particle size. When the average particle size exceeds 1 μm, electric resistances may be hard to control.

The resin layer can be formed by the method, for example, in which the silicone resin and the like are dissolved in a solvent to prepare an application solution, thereafter this application solution is uniformly applied by the known application method onto the surface of the core member, dried, and then baked. The application methods include, for example, dipping method, spray method, and brush application method.

The solvents may be suitably selected depending on the purpose without particular limitation, and include, for example, toluene, xylene, methylethyl ketone, methylisobutyl ketone, celsolbutyl acetate.

The baking is not particularly limited, and may be external heating or internal heating. Examples of the baking include the methods of using a fixed-type electric furnace, a flow-type electric furnace, a rotary-type electric furnace, or a burner furnace, and the method of using microwaves.

The resin layer is preferably 0.01% by mass to 5.0% by mass in amounts in the carrier. When the amount is less than 0.01% by mass, the resin layer may not be uniformly formed on the surface of the core member. When exceeding 5.0% by mass, the resin layer is too thick, then granulation of carriers with each other occur, and thus uniform carrier particles may not be obtained.

In the case where the developer is the two component developer, the contents of the carrier in this two component developer may be suitably selected depending on the purpose without particular limitation, and are, for example, preferably 90% by mass to 98% by mass, more preferably 93% by mass to 97% by mass.

A blend ratio between toner and carrier in a two component developer is generally preferred to be 1 part by mass to 10.0 parts by mass of toner with respect to 100 parts by mass of carrier.

Developers for use in the present invention are preferably used in forming images by various known electro-photography such as magnetic one-component development method, non-magnetic one-component development method, and binary development method.

The developing unit may be of drying developing type or wet developing type, or may be a single-color developing unit or a multi-color developing unit. The developing units include, for example, preferably the ones that have agitator that stirs in friction the toner or the developer to be charged, and a ratable magnet roller.

In the developing unit, for example, the toner and the carrier are mixed and stirred, this toner is charged due to friction in this process and held in the napping state on the surface of a magnet roller in rotation, and a magnetic brush is formed. Since this magnet roller is disposed in the vicinity of the latent electrostatic image bearing member (photoconductor), a part of the toner that forms the magnetic brush formed on the surface of this magnet roller, is transferred to the surface of this latent electrostatic image bearing member (photoconductor) due to an electrical absorption. As a result, the electrostatic latent is developed with this toner, and then a visible image is formed with this toner on the surface of this latent electrostatic image bearing member (photoconductor).

A developer contained in the developing unit is a developer containing the toner, and this developer may be a one-component developer or a two component developer.

—Transfer and Transferring Unit—

In the transfer, the visible image is transferred to a recording medium. In a preferred aspect, the visible image is transferred to an intermediate transfer member as a primary transfer, the visible image is then transferred on the recording member as a secondary transfer. More preferably, using a toner or two or more colors and still more preferably using a full color toner, the visible image is transferred to the intermediate transfer member to form a complex-transfer image as the primary transfer, and the complex-transfer image is transferred to the recording medium as the secondary transfer.

The transfer of the visible image may be achieved, for example, by charging the photoconductor using a transfer-charger, which may be performed by the transferring unit. In a preferred aspect, the transferring unit comprises a primary transferring unit that transfers the visible image to the intermediate transfer member to form a complex-transfer image, and a secondary transferring unit that transfers the complex-transfer image to the recording medium.

The intermediate transfer member is not particularly limited and may be selected transferring members known in the art, for instance, a transferring belt is favorable.

The transferring unit (the primary transferring unit and the secondary transferring unit) preferably comprises an image transcriber that conducts releasing charge the visible image formed on the photoconductor to the side of recording medium. The transfer unit may be one or more.

Examples of the image transcriber include a corona image transcriber according to corona discharge, a transfer belt, a transfer roller, a pressure transfer roller, and an adhesion image transcriber.

The recording medium is typically a plain paper, but is not particularly limited, provided that a polyethylene terephthalate (PET) base for overhead projector (OHP) may be employed.

—Fixing Step and Fixing Unit—

The fixing step is a process for fixing a visible image having been transferred onto a recording medium using a fixing unit, may be conducted each time of transfer onto the recording medium with respect to each color toner, or may be conducted spontaneously at a time in the laminated state of each color toner.

The fixing units may be suitably selected depending on the purpose without particular limitation. However, preferred is the ones which include at least two fixing members that are capable of in contact with each other to form a nip portion, and fixing an image on the recording medium by passing through this nip portion the recording medium on which the image of toner has been transferred, and which further include other members suitably selected depending on the purpose as needed.

As the fixing unit, particularly preferred are fixing units including a fixing roller disposed in parallel to the heating roller; a toner heating medium formed of an endless strip which is stretched between the heating roller and the fixing roller and which is heated by the heating roller and rotated by the heating roller and the fixing roller; and a pressure roller which is pressed against the fixing roller. through the toner heating medium and which is rotated in a direction in which the toner heating medium moves to thereby form a nip portion.

The nip portion is formed by at least two the fixing members being in contact with each other.

Contact pressures at the nip portion may be suitably selected depending on the purpose without particular limitation, and may be preferably 7 $N/cm^2$ to 50 $N/cm^2$.

An intermediate region situated between the introduction side end and the ejection side end of the recording medium at the nip portion may be positioned substantially collinear with the introduction side end and the ejection side end, or may be positioned on the side of an image contact-side fixing member that is situated on the contact side with respect to an image. In the case where the intermediate region is positioned on the side of the image contact-side fixing member, since the ejection of the recording medium from the nip portion is in a direction of taking it from the fixing member, it is possible to prevent the recording medium from being wound around the fixing member.

The fixing members are not particularly limited insofar as is capable of being contact with each other to form a nip portion, and may be suitably selected depending on the purpose. For example, the fixing members include the combination of an endless belt and a roller, and the combination of a roller and a roller. However, in respect of a shorter warm-up time period, as well as realization of energy saving, preferably the combination of an endless belt and a roller, or the heating method form the surface of the fixing member by induction heating is preferably employed.

As the fixing members, for example, there is known heating pressurizing unit (the combination of heating unit and pressurizing unit). The heating pressurizing unit includes, for example, the combination of a heating roller, a pressure roller, and an endless belt in the case of the combination of the endless-shaped belt and the roller, and include, for example, the combination of a heating roller and a pressure roller in the case of the combination of the roller and the roller.

In the case where the fixing member is an endless-shaped belt, preferably this endless-shaped belt is made of materials having a small heat capacity, and includes one in which, for example, there is provided on a base an offset preventing layer. Materials forming the base include, for example, nickel and polyimide. Materials forming the offset preventing layer include, for example, silicone rubber, and a fluorine-based resin.

In the case where the fixing member is a roller, preferably a core metal of this roller is made of a non-elastic member in order to prevent the deformation (deflection) due to a high pressure. These non-elastic members may be suitably selected depending on the purpose without particular limitation. For example, the non-elastic members preferably include high thermal conductivity materials such as aluminum, iron, stainless steel, and brass. Moreover, the roller is preferably covered with an offset preventing layer at the surface thereof. Materials forming this offset preventing layer may be suitably selected depending on the purpose without particular limitation, and preferably include, for example, RTV silicone rubber, tetrafluoroethylene-perfluoroalkyl vinylether (PFA), a polytetrafluoroethylene (PTFE).

The fixing member itself may include heating unit, and may have a function as a heating member. Preferably, however, at least a part of the surface of at least one the fixing member is heated. Such heating unit may be suitably selected depending on the purpose without particular limitation, and include, for example, electromagnetic induction heating unit.

The electromagnetic induction heating unit may be suitably selected depending on the purpose without particular limitation, and preferably may be formed of, for example, an induction coil disposed so as to be close to the fixing member (for example, a heating roller), a shield layer where this induction coil is located, and an insulating layer located on the side opposite to the surface where the induction coil of this shield layer is located. In this case, the heating roller is preferably one made of a magnetic body, or a heat pipe.

The induction coil is preferably located in the state of surrounding at least a semi-cylindrical portion on the side opposite to the contact section between the heating roller and the fixing member (for example, a pressure roller, or an endless-shaped belt).

Temperatures of fixing an image to the recording medium with the toner, that is, surface temperatures of the fixing member provided by the heating unit may be suitably selected depending on the purpose without particular limitation, and for example, are preferably 120° C. to 170° C., more preferably 120° C. to 160° C. Supposing that this fixing temperature is less than 120° C., fixing property comes to be insufficient; and supposing that this fixing temperature is more than 170° C., it is not preferred in respect of the realization of energy saving.

Furthermore, in the present invention, depending on the purpose, together with the fixing step and fixing unit, or instead of these, for example, known UV-fixable equipment may be used.

Figure 2:
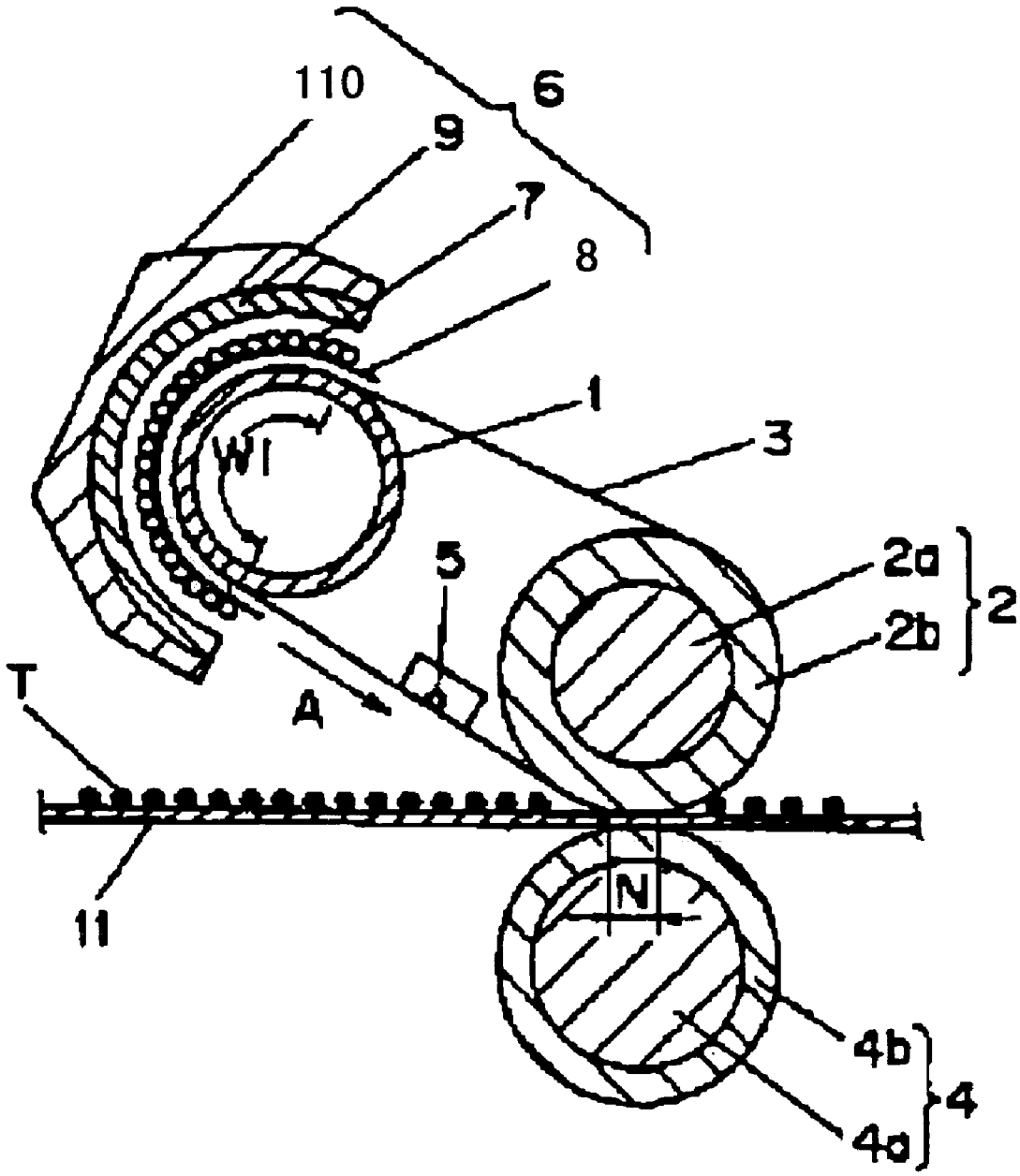
FIG. 2 is an explanatory view showing a fixing unit according to a preferred embodiment of the present invention.

Herein, the fixing unit shown in FIG. 2 is formed of a heating roller 1 heated by electromagnetic induction provided by induction heating unit 6, a fixing roller 2 disposed in parallel with the heating roller 1, a heat resistant belt (toner heating medium) 3 (an endless strip) that is stretched between the heating roller 1 and the fixing roller 2, heated by the heating roller 1, and rotated in a direction indicated by arrow A by the rotation of at least any one of these rollers, and a pressure roller 4 that is pressed against the fixing roller 2 via the belt 3 as well as rotated in a forward direction with respect to the belt 3.

The heating roller 1 is made of a magnetic metal member of a hollow cylindrical shape, for example, iron, cobalt, nickel or an alloy of these metals. This heating roller 1 is 20 mm in an outer diameter, and 0.1 mm in thickness, to be in construction of low heat capacity and a rapid rise of temperature.

The fixing roller 2 is formed of a core metal 2*a* made of metal, for example, stainless steel, and an elastic member 2*b* made of a solid or foam-like silicone rubber having a heat resistance to be coated on the core metal 2*a*. Further, to form a contact section of a predetermined width between the pressure roller 4 and the fixing roller 2 by a compressive force provided by the pressure roller 4, the fixing roller 2 is constructed to be 40 mm in an outer diameter to be larger than the heating roller 1. The elastic member 2*b* is approximately 3 mm to 6 mm in thickness, and is approximately 40 to 600 (Asker hardness) in hardness. Owing to this construction, the heat capacity of the heating roller 1 is smaller than the heat capacity of the fixing roller 2, so that the heating roller 1 is rapidly heated to make warm-up time period shorter.

The belt 3 that stretched between the heating roller 1 and the fixing roller 2 is heated at a contact section W1 with the heating roller 1 to be heated by induction heating unit 6. Then, an inner surface of the belt 3 is continuously heated by the rotation of the rollers 1 and 2, and as a result, the whole belt will be heated.

A release layer, being a surface layer of the belt 3 is preferably 50 μm to 500 μm in thickness, and more preferably 50 μm to 200 μm. In this manner, since the surface layer of the belt 3 sufficiently covers a toner image T formed on a recording medium 111, it becomes possible to uniformly heat and melt a toner image T.

When the release layer is less than 50 μm in thickness, a heat capacity of the belt 3 comes to be smaller, a belt surface temperature is rapidly decreased in the toner fixing step, and thus a sufficient fixing property cannot be ensured. In addition, when the release layer exceeds 500 μm in thickness, the heat capacity of the belt 3 comes to be larger, resulting in a longer warm-up time period. Further, additionally, a belt surface temperature is unlikely to decrease in the toner-fixing step, a cohesion effect of melted toner at an outlet of the fixing portion cannot be obtained, and thus the so-called hot offset occurs in which a releasing property of the belt is lowered, and toner is adhered to the belt. Moreover, as a base member of a belt 3, instead of a heating layer, being the inside of the belt 3 made of the above-the metals, may be used a resin layer having a heat resistance, such as a fluorine-based resin, a polyimide resin, a polyamide resin, a polyamide-imide resin, a PEEK resin, PES resin, and a PPS resin.

The pressure roller 4 is constructed of a core metal 4*a* of a cylindrical member made of metal having a high thermal conductivity, for example, copper or aluminum, and an elastic member 4*b* having a high heat resistance and toner releasing property that is located on the surface of this core metal 4*a*. The core metal 4*a* may be made of SUS other than the above-the metals.

The pressure roller 4 presses the fixing roller 2 via the belt 3 to form a nip portion N. According to this embodiment, the pressure roller 4 is arranged to engage into the fixing roller 2 (and the belt 3) by causing the hardness of the pressure roller 4 to be higher than that of the fixing roller 2, whereby the recording medium 111 is in conformity with the circumferential shape of the pressure roller 4, thus to provide the effect that the recording medium 111 is likely to come off from the surface of the belt 3. This pressure roller 4 is approximately 40 mm in an external diameter as is the fixing roller 2. This pressure roller 4, however, is approximately 1 mm to 3 mm in thickness, to be thinner than the fixing roller 2. This pressure roller 4 is 50° to 70° in hardness (Asker hardness) to be constructed harder than the fixing roller 2 as described above.

Figure 3A:
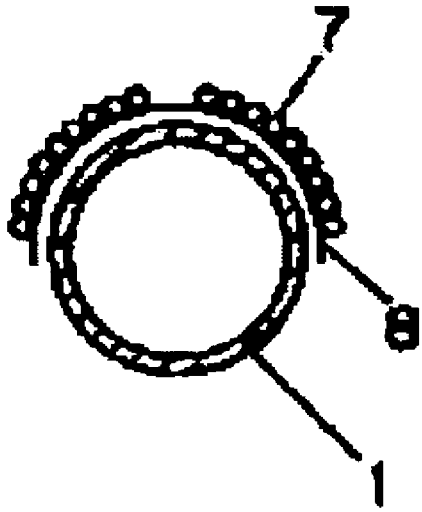
FIG. 3A is a sectional view showing the layout of an exciting coil of induction heating unit in the fixing unit according to the present invention.
Figure 3B:
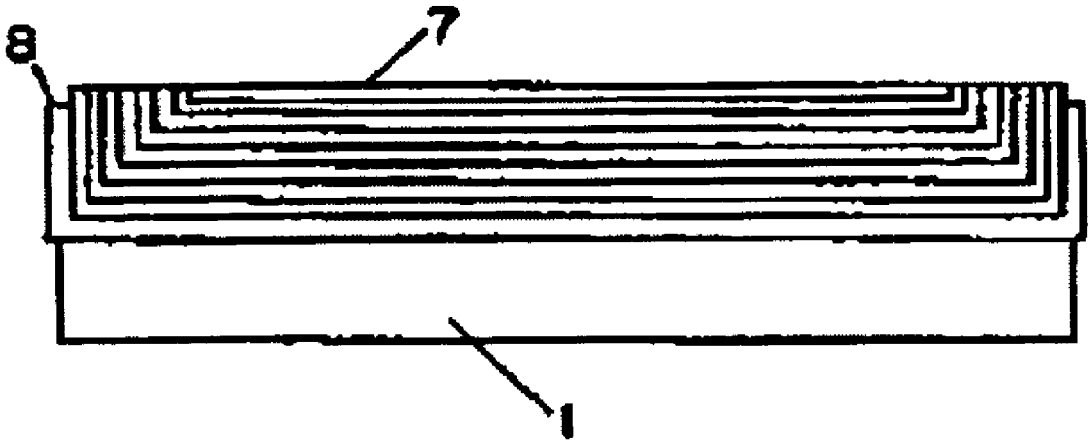
FIG. 3B is a side view showing the layout of the exciting coil of induction heating unit in the fixing unit according to the present invention.

Induction heating unit 6 for heating the heating roller 1 by electromagnetic induction, as shown in FIGS. 2, 3A and 3B, includes an exciting coil 7 acting as field generation unit, and a coil guide plate 8 around which this exciting coil 7 is wound. The coil guide plate 8 has a semi-cylindrical shape that is located close to the perimeter surface of the heating roller 1. The exciting coil 7, as shown in FIG. 3B, is the one in which one long exciting coil wire is wound alternately in an axial direction of the heating roller 1 along this coil guide plate 8. Further, in the exciting coil 7, an oscillation circuit is connected to a driving power source (not shown) of variable frequencies.

Outside of the exciting coil 7, an exciting coil core 9 of a semi-cylindrical shape that is made of a ferromagnetic material such as ferrites is fixed to an exciting coil core support 10 to be located in the proximity of the exciting coil 7. Moreover, according to this embodiment, the exciting coil core 9 employs the one having a relative permeability of 2,500.

The exciting coil 7 is fed with a high-frequency AC of 10 kHz to 1 MHz, preferably a high-frequency AC of 20 kHz to 800 kHz from the driving power source, whereby an alternating magnetic filed is generated. Then, this alternating magnetic field acts on the heating roller 1 and a heating layer of the belt 3 in the contact region W1 between the heating roller 1 and the heat resistant belt 3, and in the vicinity thereof, and an eddy current I flows in a direction of preventing the change of this alternating magnetic field in an internal part thereof.

This eddy current I causes Joule heat based on resistances of the heating roller 1 and the heating layer, and the heating roller 1 and the belt 3 having the heating layer are heated by electromagnetic induction mainly in the contact region between the heating roller 1 and the belt 3, and in the vicinity thereof.

In the belt 3 heated like this, temperatures at the belt inner surface is detected by temperature detection unit 5 made of a temperature sensing element having a high thermal responsiveness such as thermistor disposed in contact with the inner surface side of the belt 3 in the vicinity of the inlet side of the nip portion N The charge eliminating step is a step of applying a bias to the charged latent electrostatic image bearing member for elimination of charges. This is suitably performed by means of the charge eliminating unit.

The charge eliminating unit is not particularly limited as long as it is capable of applying a charge eliminating bias to the latent electrostatic image bearing member, and can be appropriately selected from known charge eliminating units depending on the intended purpose. A suitable example thereof is a charge eliminating lamp and the like.

The cleaning step is a step of removing toner particles remained on the latent electrostatic image bearing member. This is suitably performed by means of the cleaning unit. The cleaning unit is not particularly limited as long as it is capable of eliminating such toner particles from the latent electrostatic image bearing member, and can be suitably selected from known cleaners depending on the intended use. Examples thereof include a magnetic blush cleaner, an electrostatic brush cleaner, a magnetic roller cleaner, a blade cleaner, a blush cleaner, and a wave cleaner The recycling step is a step of recycling the toner particles removed through the cleaning step to the developing unit. This is suitably performed by means of the recycling unit.

The recycling unit is not particularly limited and can be appropriately selected from conventional conveyance systems.

The controlling step is a step of controlling the foregoing steps. This is suitably performed by means of the controlling unit.

The controlling unit is not particularly limited as long as the operation of each step can be controlled, and can be appropriately selected depending on the intended use. Examples thereof include equipment such as sequencers and computers.

One embodiment of the image forming method of the present invention by means of the image forming apparatus will be described with reference to FIG. 6. Image forming apparatus 100 shown in FIG. 6 contains a photoconductor drum 10 (hereinafter referred to as "photoconductor 10") as the latent electrostatic image bearing member, a charging roller 20 as the charging unit, an exposure device 30 as the exposing unit, a developing device 40 as the developing unit, an intermediate transferring member 50, a cleaning device 60 as the cleaning unit having a cleaning blade, and a charge eliminating lamp 70 as the charge eliminating unit.

Intermediate transferring member 50 is an endless belt, and is so designed that it loops around three rollers 51 disposed its inside and rotates in the direction shown by the arrow by means of rollers 51. One or more of three rollers 51 also functions as a transfer bias roller capable of applying a certain transfer bias (primary bias) to the intermediate transferring member 50. Cleaning blade 90 is provided adjacent to the intermediate transferring member 50. There is provided a transferring roller 80 facing to the intermediate transferring member 50 as the transferring unit capable of applying a transfer bias so as to transfer a developed image (toner image) to a transfer sheet 95 as a recording medium (secondary transferring). Moreover, there is provided a corona charger 58 around the intermediate transferring member 50 for applying charges to the toner image transferred on the intermediate transferring medium 50. Corona charger 58 is arranged between the contact region of the photoconductor 10 and the intermediate transferring medium 50 and the contact region of the intermediate transferring medium 50 and the transfer sheet 95, in the rotational direction of the intermediate transferring medium 50.

Developing device 40 contains a developing belt 41 as a developer bearing member, a black developing unit 45K, a yellow developing unit 45Y, a magenta developing unit 45M and a cyan developing unit 45C, these developing units being positioned around the developing belt 41. The black developing unit 45K contains a developer container 42K, a developer supplying roller 43K, and a developing roller 44K. The yellow developing unit 45Y contains a developer container 42Y, a developer supplying roller 43Y, and a developing roller 44Y. The magenta developing unit 45M contains a developer container 42M, a developer supplying roller 43M, and a developing roller 44M. The cyan developing unit 45C contains a developer container 42C, a developer supplying roller 43C, and a developing roller 44C. The developing belt 41 is an endless belt looped around a plurality of belt rollers so as to be rotatable. A part of the developing belt 41 is in contact with the photoconductor 10.

Figure 6:
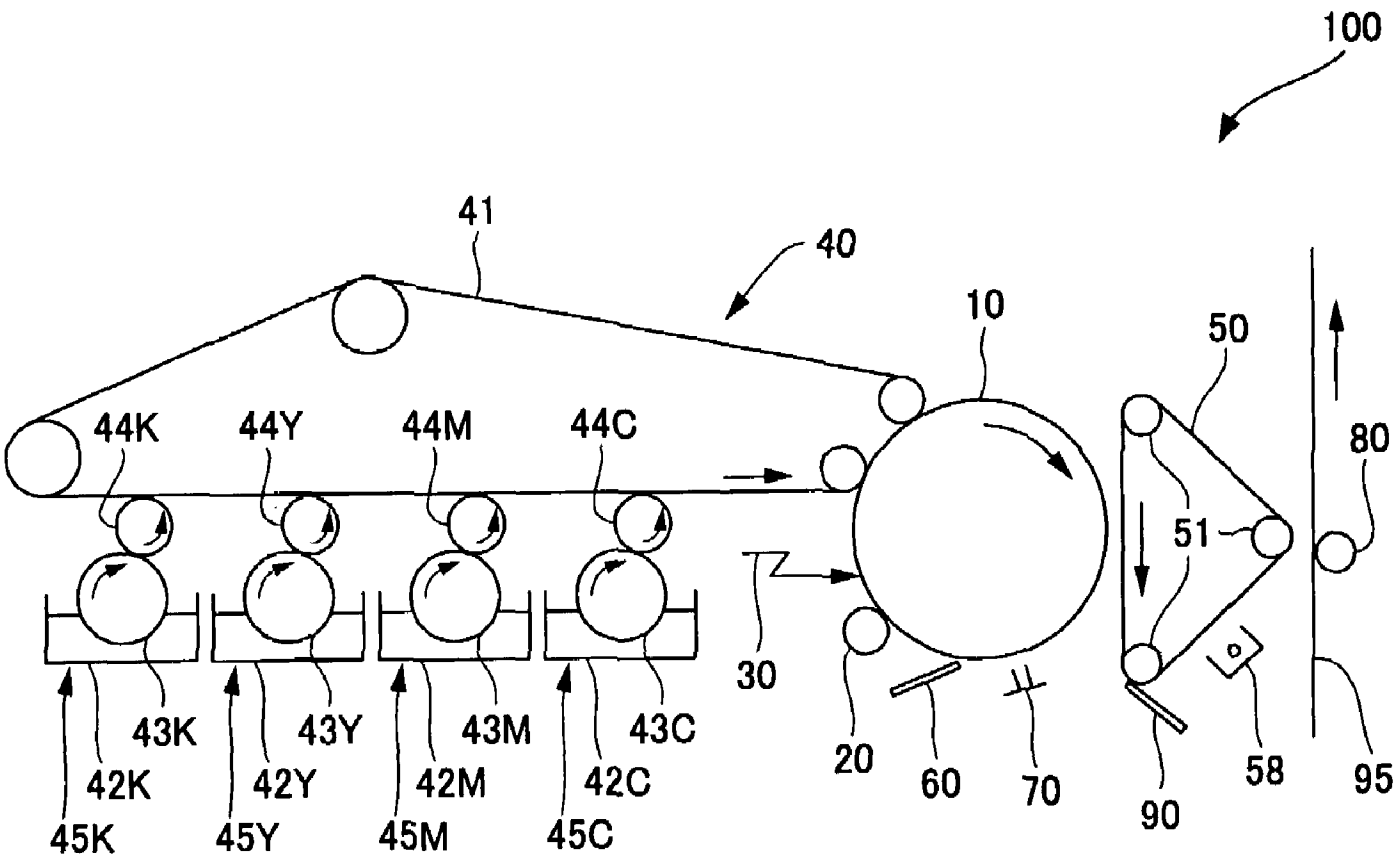
FIG. 6 is a schematic explanatory view showing one example of carrying out the image forming method according to the present invention with an image forming apparatus according to the present invention.

In image forming apparatus 100 shown in FIG. 6, the photoconductor drum 10 is uniformly charged by means of, for example, the charging roller 20. The exposure device 30 then exposes imagewisely on the photoconductor drum 10 so as to form a latent electrostatic image. The latent electrostatic image formed on the photoconductor drum 10 is provided with toner from the developing device 40 to form a visible image (toner image). The roller 51 applies a bias to the toner image to transfer the visible image (toner image) onto the intermediate transferring medium 50 (primary transferring), and further applies a bias to transfer the toner image from the intermediate transferring medium 50 to the transfer sheet 95 (secondary transferring). In this way a transferred image is formed on the transfer sheet 95. Thereafter, toner particles remained on the photoconductor drum 10 are removed by means of the cleaning device 60, and charges of the photoconductor drum 10 are removed by means of a charge eliminating lamp 70 on a temporary basis.

Figure 7:
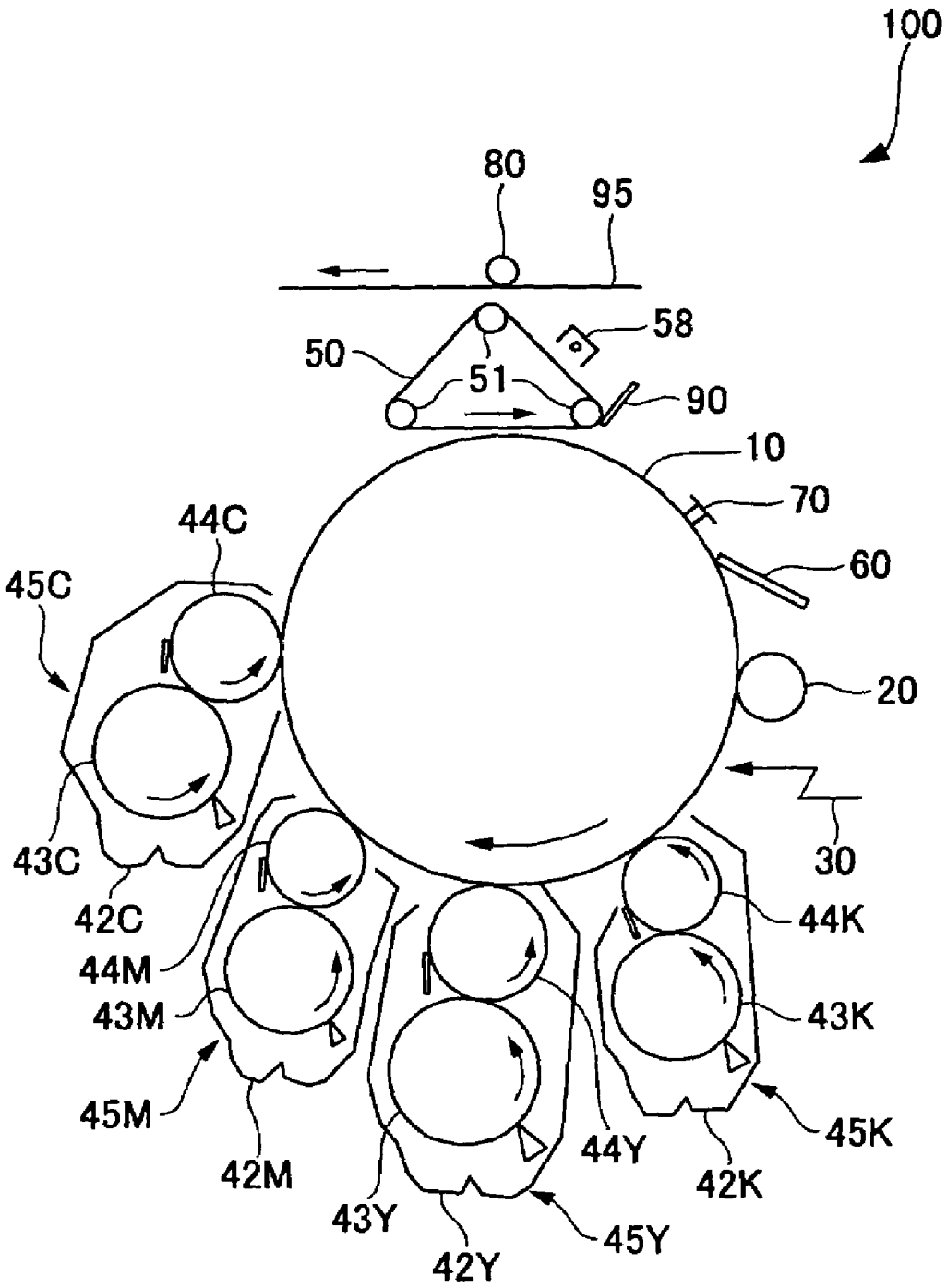
FIG. 7 is a schematic explanatory view showing another example of carrying out the image forming method according to the present invention with an image forming apparatus according to the present invention.

Another embodiment of the image forming method of the present invention by means of the image forming apparatus will be described with reference to FIG. 7. The image forming apparatus 100 shown in FIG. 7 has an identical configuration and working effects to those of the image forming apparatus 100 shown in FIG. 6 except that this image forming apparatus 100 does not contains the developing belt 41 and that the black developing unit 45K, yellow developing unit 45Y, magenta developing unit 45M and cyan developing unit 45C are disposed so as to face the photoconductor 10. Note in FIG. 7 that members identical to those in FIG. 6 are denoted by the same reference numerals.

Figure 8:
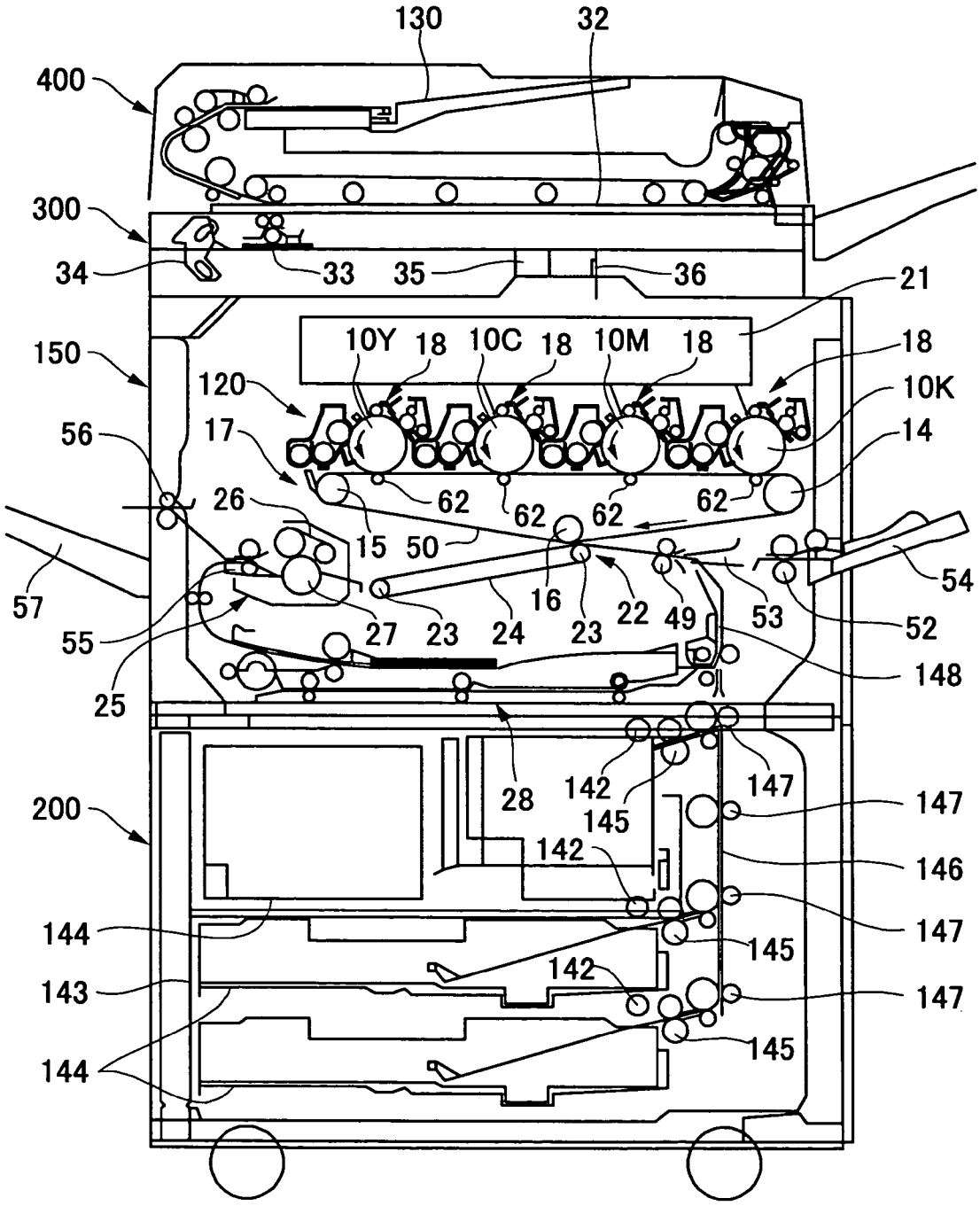
FIG. 8 is a schematic explanatory view showing one example of carrying out the image forming method according to the present invention with an image forming apparatus according to the present invention (tandem-type color image forming apparatus).

Still another embodiment of the image forming method of the present invention by means of the image forming apparatus will be described with reference to FIG. 8. Image forming apparatus 100 shown in FIG. 8 is a tandem color image-forming apparatus. The tandem image forming apparatus contains a copy machine main body 150, feeder table 200, scanner 300, and automatic document feeder (ADF) 400.

The copy machine main body 150 has an endless-belt intermediate transferring member 50 in the center. The intermediate transferring member 50 is looped around support rollers 14, 15 and 16 and is configured to be rotatable in a clockwise direction in FIG. 8. A cleaning device for intermediate transferring member 17 for the intermediate transferring member is provided in the vicinity of the support roller 15. The cleaning device for intermediate transferring member 17 removes toner particles remained on the intermediate transferring member 50. On the intermediate transferring member 50 looped around the support rollers 14 and 15, four color-image forming devices 18—yellow, cyan, magenta, and black—are aligned along the conveying direction so as to face the intermediate transferring member 50, which constitutes a tandem developing unit 120. An exposing unit 21 is arranged adjacent to the tandem developing unit 120. A secondary transferring unit 22 is arranged across the intermediate transferring member 50 from the tandem developing unit 120. The secondary transferring unit 22 contains a secondary transferring belt 24, which is an endless belt and looped around a pair of rollers 23. A transferred sheet which is conveyed on the secondary transferring belt 24 is allowed to contact the intermediate transferring member 50. An image fixing unit 25 is arranged in the vicinity of the secondary transferring unit 22. The image fixing unit 25 contains a fixing belt 26 which is an endless belt, and a pressurizing roller 27 which is pressed by the fixing belt 26.

In the tandem image forming apparatus, a sheet reverser 28 is arranged adjacent to both the secondary transferring unit 22 and image fixing unit 25. A sheet reverser 28 turns over a transferred sheet to form images on the both sides of the sheet.

Next, full-color image formation (color copying) using a tandem developing unit 120 will be described. At first, a source document is placed on a document tray 130 of an automatic document feeder 400. Alternatively, the automatic document feeder 400 is opened, the source document is placed on a contact glass 32 of a scanner 300, and the automatic document feeder 400 is closed.

When a start switch (not shown) is pushed, the source document placed on the automatic document feeder 400 is transferred onto the contact glass 32, and the scanner 300 is then driven to operate first and second carriages 33 and 34. In a case where the source document is originally placed on the contact glass 32, the scanner 300 is immediately driven after pushing of the start switch. Light is applied from a light source to the document by means of the first carriage 33, and light reflected from the document is further reflected by the mirror of the second carriage 34. The reflected light passes through the image-forming lens 35, and read the sensor 36 receives it. In this way the color document (color image) is scanned, producing 4 types of color image information—black, yellow, magenta, and cyan.

Figure 9:
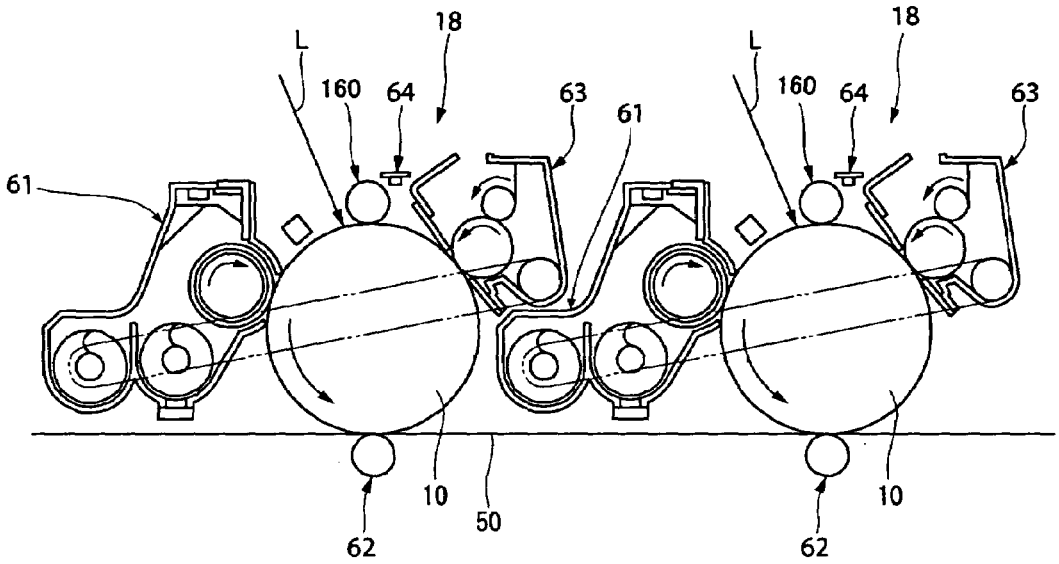
FIG. 9 is a partially enlarged schematic explanatory view in the image forming apparatus shown in FIG. 8.

Each image information of black, yellow, magenta, and cyan is transmitted to an image forming unit 18 (black image forming unit, yellow image forming unit, magenta image forming unit, or cyan image forming unit) of the tandem developing unit 120, and toner images of each color are formed in each image-forming unit 18. As shown in FIG. 9, each image-forming unit 18 (black image-forming unit, yellow image forming unit, magenta image forming unit, and cyan image forming unit) of the tandem developing unit 120 contains: a photoconductor 10 (photoconductor for black 10K, photoconductor for yellow 10Y, photoconductor for magenta 10M, or photoconductor for cyan 10C); a charging device 160 for uniformly charging the photoconductor 10; an exposing unit for forming a latent electrostatic image corresponding to the color image on the photoconductor by exposing imagewisely (denoted by "L" in FIG. 9) on the basis of the corresponding color image information; a developing device 61 for developing the latent electrostatic image using the corresponding color toner (black toner, yellow toner, magenta toner, or cyan toner) to form a toner image; a transfer charger 62 for transferring the toner image to an intermediate transferring member 50, a cleaning device 63, and a charge eliminating device 64. Thus, images of one color (a black image, a yellow image, a magenta image, and a cyan image) can be formed based on the color image information. The black toner image formed on the photoconductor for black 10K, yellow toner image formed on the photoconductor for yellow 10Y, magenta toner image formed on the photoconductor for magenta 10M, and cyan toner image formed on the photoconductor for cyan 10C are sequentially transferred onto the intermediate transferring member 50 which rotates by means of support rollers 14, 15 and 16 (primary transferring). These toner images are superimposed on the intermediate transferring member 50 to form a composite color image (color transferred image).

Meanwhile, one of feed rollers 142 of the feed table 200 is selected and rotated, whereby sheets (recording sheets) are ejected from one of multiple feed cassettes 144 in a paper bank 143 and are separated one by one by a separation roller 145. Thereafter, the sheets are fed to feed path 146, transferred by a transfer roller 147 into a feed path 148 inside the copying machine main body 150, and are bumped against the resist roller 49 to stop. Alternatively, one of the feed rollers 142 is rotated to eject sheets (recording sheets) placed on a manual feed tray 54. The sheets are then separated one by one by means of the separation roller 145, fed into a manual feed path 53, and similarly, bumped against the resist roller 49 to stop. Note that the resist roller 49 is generally earthed, but it may be biased for removing paper dusts on the sheets. The resist roller 49 is rotated synchronously with the movement of the composite color image (color transferred image) on the intermediate transferring member 50 to transfer the sheet (recording sheet) into between the intermediate transferring member 50 and the secondary transferring unit 22, and the composite color image (color transferred image) is transferred onto the sheet by means of the secondary transferring unit 22 (secondary transferring). In this way the color image is formed on the sheet (recording sheet). Note that after image transferring, toner particles remained on the intermediate transferring member 50 are cleaned by means of the cleaning device for intermediate transferring member 17.

The sheet (recording sheet) bearing the transferred color image is conveyed by the secondary transferring unit 22 into the image fixing unit 25, where the composite color image (color transferred image) is fixed onto the sheet (recording sheet) by heat and pressure. Thereafter, the sheet changes its direction by action of a switch hook 55, ejected by an ejecting roller 56, and stacked on an output tray 57. Alternatively, the sheet changes its direction by action of the switch hook 55, flipped over by means of the sheet reverser 28, and transferred back to the image transfer section for recording of another image on the other side. The sheet that bears images on both sides is then ejected by means of the ejecting roller 56, and is stacked on the output tray 57.

<Process Cartridge>

The process cartridge to be used in the present invention includes at least an latent electrostatic image bearing member acting to carry an electrostatic image, and developing unit for developing with the use of toner an electrostatic image that is carried on this latent electrostatic image bearing member, to form a visible image, and further includes other unit suitably selected as necessary, such as charging unit, developing unit, transfer unit, cleaning unit, and charge removing unit.

The developing unit at least includes a developer reservoir containing therein the toner or the developer, and a developer carrier that carries and delivers a toner or developer contained in this developer reservoir, and further may include e.g., a layer thickness regulation member for regulating a layer thickness of toner to be carried.

The process cartridge can be mounted detachably onto various electro-photographic machines, facsimiles, and printers, and preferably may be mounted detachably onto the image forming apparatus according to the present invention as described below.

Figure 10:
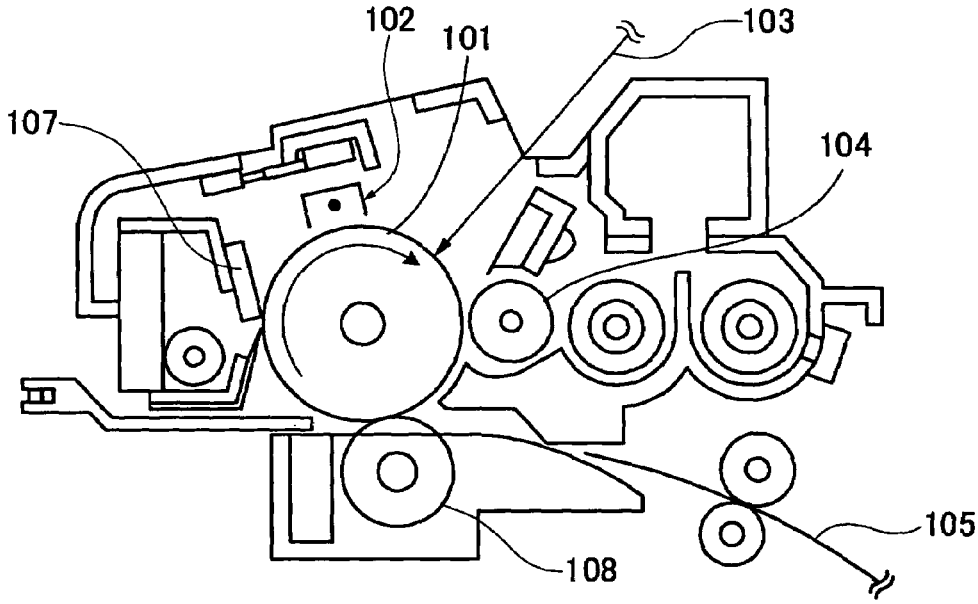
FIG. 10 is a schematic view showing an example of a process cartridge for use in the present invention.

Herein, the process cartridge, for example, as shown in FIG. 10, contains therein a photoconductor 101, includes charging unit 102, developing unit 104, transfer unit 108, and cleaning unit 107, and further includes other unit as necessary. In FIG. 10, reference numeral 103 designates exposure provided by exposure unit, and reference numeral 105 designates a recording medium respectively.

The photoconductor 101 may employ the same one as in the below-described image forming apparatus.

The charging unit 102 uses any charging member.

Now, the image forming process with the process cartridge shown in FIG. 10 is described. The photoconductor 101, while being rotated in a direction indicated by an arrow in the drawing, is formed with an electrostatic latent corresponding to an exposure image on the surface thereof due to electrostatic charge provided by charging unit 102 and exposure 103 provided by exposure unit (not shown). This electrostatic latent is toner-developed by developing unit 104, and this toner-developed image is transferred to a recording medium 105 by transfer unit 108, and printed out. Subsequently, the photoconductor surface after the image has been transferred is cleaned by cleaning unit 107, and electrical charges are removed by a charge removing unit (not shown). Then, these operations will be repeated.

As an image forming apparatus according to the present invention, the latent electrostatic image bearing member and components such as a developing unit and a cleaning unit may be joined in an integral structure as a process cartridge, and this unit may be constructed to be detachable with respect to the apparatus body. Furthermore, at least one of a charger, an image exposure unit, a developing unit, a transfer or separation unit, and a cleaning unit is supported integrally together with an latent electrostatic image bearing member to form a process cartridge. This process cartridge, being a removable single unit with respect to the apparatus body, may be structured to be removable using a guide unit such as a rail in the apparatus body.

In an image forming method and an image forming apparatus according to the present invention, by using toner having a superior cleaning property, as well as a high chargeability, and preferably a fixing unit of a specified electromagnetic induction heating type, it is possible to efficiently obtain a high-resolution image having a superior offset resistance as well as a superior fixing property at low temperature fixing property, and with no background smear.

EXAMPLES

Hereinafter, examples according to the present invention are described, but the present invention is never limited to the below-the examples. Further, in the below-the examples, "parts" means "parts by mass", and "%" means "% by mass."

Manufacturing Example 1

—Synthesis of Organic Fine Particle Emulsion—

Into a reaction vessel equipped with a stirrer and a thermometer, 683 parts of water, 11 parts of a sodium salt of a sulfate ester of methacrylic acid ethylene oxide adduct (Eleminol RS-30, manufactured by Sanyo Chemical Industries Ltd.), 80 parts of styrene, 83 parts of methacrylic acid, 110 parts of butyl acrylate, 12 parts of butyl thioglycolate, and 1 part of ammonium persulfate were fed, and stirred at 400 revolutions per minute for 15 minutes to obtain a white emulsion. This emulsion was warmed to a system temperature of 75° C. and then reacted for 5 hours. Further, 30 parts of a 1% aqueous ammonium persulfate solution was admixed thereto, and the resulting mixture was matured at 75° C. for 5 hours to synthesize an aqueous dispersion of a vinyl resin (a copolymer of styrene-methacrylic acid-butyl acrylate-a sodium salt of a sulfate ester of methacrylic acid ethylene oxide adduct). This product was to be Fine Particle Dispersion 1.

The volume average particle diameter of the obtained Fine Particle Dispersion 1 with the use of a laser diffraction-type particle size distribution-measuring instrument (LA-920, manufactured by Shimadzu Corporation) was 120 nm. Further, a part of Fine Particle Dispersion 1 was dried, and a resin content was isolated. The glass transition temperature (Tg) of this resin content was 72° C., and the weight average molecular weight (Mw) was 30,000.

—Preparation of Aqueous Phase—

990 parts of water, 83 parts of Fine Particle Dispersion 1, 37 parts of an aqueous solution of 48.5% dodecyldiphenyl ether sodium disulfonate (Eleminol MON-7, manufactured by Sanyo Chemical Industries Ltd.) were mixed and stirred to prepare an opaque white liquid. This resulting product was to be Aqueous Phase 1.

—Synthesis of Low-Molecular Polyester—

In a reaction vessel equipped with a cooling tube, an agitator and a nitrogen inlet tube, 229 parts of a bisphenol A ethylene oxide (2 mol) adduct, 529 parts of a bisphenol A propylene oxide (3 mol) adduct, 208 parts of terephthalic acid, 46 parts of adipic acid, and 2 parts of dibutyltin oxide were put, and reacted under atmospheric pressure at 230° C. for 8 hours. Subsequently, after having been reacted for 5 hours under reduced pressure of 10 mmHg to 15 mmHg, the resulting product in the reaction vessel was added with 44 parts of trimellitic anhydride, and reacted for 2 hours at 180° C. under atmospheric pressure to synthesize polyester. This product was to be Low-Molecular Polyester 1.

Obtained Low-Molecular Polyester 1 was 2,500 in number average molecular weight (Mn), 6,700 in weight average molecular weight (Mw), 43° C. in glass transition temperature (Tg), and 25 mgKOH/g in acid value.

—Synthesis of Intermediate Polyester—

In a reaction vessel equipped with a cooling tube, an agitator and a nitrogen inlet tube, 682 parts of a bisphenol A ethylene oxide (2 mol) adduct, 81 parts of a bisphenol A propylene oxide (2 mol) adduct, 283 parts of terephthalic acid, 22 parts of trimellitic anhydride and 2 parts of dibutyltin oxide were put, and reacted for 8 hours at 230° C. under atmospheric pressure. Subsequently, the resulting product was reacted for 5 hours under reduced pressure of 10 mmHg to 15 mmHg, to synthesize polyester. This product was to be Intermediate Body Polyester 1.

Obtained Intermediate Body Polyester 1 was 2,100 in number average molecular weight (Mn), 9,500 in weight average molecular weigh (Mw), 55° C. in glass transition temperature (Tg), 0.5 mgKOH/g in acid value, and 51 mgKOH/g in hydroxyl value.

Then, in a reaction vessel equipped with a cooling tube, an agitator, and a nitrogen inlet tube, 410 parts of Intermediate Body Polyester 1, 89 parts of isophorone diisocyanate, and 500 pars of ethyl acetate were put, and reacted for 5 hours at 100° C. to obtain an addition reaction product. This product was to be Prepolymer 1. A free isocyanate percent by mass of obtained Prepolymer 1 was 1.53%.

—Synthesis of Ketimine—

In a reaction vessel equipped with a stirring rod and a thermometer, 170 parts of isoholon diamine and 150 parts of methyl-ethyl-ketone were put, and reacted for 5 hours at 50° C. to synthesize a ketimine compound. This product was to be Ketimine Compound 1. An amine value of obtained Ketimine Compound 1 was 418.

—Synthesis of Master-Batch—

In a reaction vessel, 1,200 parts of water, 540 parts of carbon black (Printex 35, manufactured by Deggsa Co.) (DBP oil absorption=42 ml/100 mg, pH=9.5), and 1200 parts of polyester rein (RS801, manufactured by Sanyo Chemical Industries, Ltd.) were added and mixed with Henschel mixer (manufactured by Mitsui Mining Co., Ltd.). The mixture having been obtained was kneaded for 30 minutes at 150° C. using two rolls, thereafter rolled and cooled, and milled with a pulverizer. This product was to be Bk Master Batch 1.

—Preparation of Oil Phase—

In a reaction vessel equipped with a stirring rod and a thermometer, 500 parts of Low Molecular Polyester 1 (polyester resin (manufactured by Sanyo Chemical Industries, Ltd., RS801)), 30 parts of carnauba wax, and 850 parts of ethyl acetate were put, warmed to 80° C. under stirring, held for 5 hours as it is at 80° C., and thereafter cooled to 30° C. over 1 hour. Further, using a beads mill (Ultra-viscomill (manufactured by Imex Corp.), wax is dispersed on the conditions of solution feed velocity: 1 kg/hr, disk circumferential speed: 6 m/sec, 0.5 mm zirconia beads loading: 80% by volume, and pass number: 3 times. Subsequently, 110 parts of Bk Master Batch 1, and 500 parts of ethyl acetate were fed into the vessel, and mixed for 1 hour to obtain a dissolved product. This product was to be Bk Raw Material Solution.

Then, 900 parts of Bk Raw Material Solution was transferred into the vessel, and added with 50 parts of ethyl acetate and 165 parts of methyl ethyl ketone (MEK), to obtain a dispersion liquid on the conditions of solution feed velocity: 1 kg/hr, disk circumferential speed: 8 m/sec, 0.5 mm zirconia beads loading: 80% by volume, and pass number: 3 times. This resulting product was to be Bk Pigment and Wax Dispersion.

To 100 parts of Bk Pigment and Wax Dispersion, 25 parts of inorganic fine particles (organo silica sol MEK-ST-UP (solid content concentration (ER)=20%), average primary particle size=15 nm, manufactured by Nissan Chemical Industries, Ltd.) was added, and mixed with a TK homomixer. A product having been obtained was to be Bk Oil Phase. The number of revolutions of a mixer is preferably in a range of 5,000 rpm to 12,000 rpm. A time period is preferably approximately 5 minutes to 20 minutes.

In this example, at temperature of 25° C. at the time of mixing, the number of revolutions of the TK homomixer is 6,500 rpm, and a time period of rotation is 10 minutes.

—Emulsification, De-Solventization, and Toner Particle Deformation—

120 parts of Bk Oil Phase, 20 parts of Prepolymer 1, and 1.2 parts of Ketimine Compound 1 were mixed to obtain Preparation 1 of Resin and Colorant of 50% solid content concentration. Then, 150 parts of Preparation 1 of Resin and Colorant was added to 200 parts of Aqueous Phase 1, and thereafter, using TK homomixer (manufactured by Tokushu Kika Kogyo Co., Ltd.), mixed for 1 minute at 25° C. at the number of revolutions of 12,000 rpm, to obtain an emulsified dispersion (1). Further, Bk Oil Phase is preferably used for emulsification within 12 hours since preparation.

100 parts of this emulsified dispersion (1) was transferred to in a stainless teardrop-shaped flask with helical ribbon-typed 3-stage mixing blades, under stirring at the number of revolutions of 60 rpm, and ethyl acetate was de-solventized to be a concentration in an emulsion of 5% on the conditions of for 6 hours at 25° C. in reduced pressure (10 kPa), to obtain an emulsified dispersion (Y-1).

To this emulsified dispersion (Y-1), 3.1 parts of carboxymethyl cellulose (SEROGEN HH, manufactured by Daiichi Kogyo Seiyaku Co., Ltd.) was added, and thickened, and thereafter, under stirring at the number of revolutions of 300 rpm to give share, at reduced pressure (10 kPa), an ethyl acetate was de-solventized until the concentration of an ethyl acetate in the emulsion is 3%. Further, the number of revolutions is lowered to 60 rpm, and de-solventization continues until the concentration of ethyl acetate is 1%, to obtain Dispersion Slurry 1. The viscosity after having been thickened was 25,000 mPa·s.

—Cleaning and Drying—

After 100 parts of Dispersion Slurry 1 was filtered under reduced pressure, cleaning and drying was done as follows.

(1) 100 parts of ion-exchange water was added to a filter cake, mixed with TK homomixer (for 10 minutes at the number of revolutions 12,000 rpm), and thereafter filtered.

(2) 100 parts of an aqueous solution of 0.1% sodium hydroxide was added to the filter cake of the (1), mixed with TK homomixer (for 30 minutes at the number of revolutions 12,000 rpm), and thereafter filtered under reduced pressure.

(3) 100 parts of 0.1% hydrochloric acid was added to the filter cake of the (2), mixed with TK homomixer (for 10 minutes at the number of revolutions 12,000 rpm), and thereafter filtered.

(4) 300 parts of ion-exchange water was added to the filter cake of the (3), mixed with TK homomixer (for 10 minutes at the number of revolutions 12,000 rpm), and thereafter filter operations were made twice.

(5) 100 parts of ion-exchange water was added to the filter cake of the (4), under stirring at the number of revolutions of 200 rpm, 20 parts of an aqueous solution of 1% FUTARGENT F-300 (manufactured by NEOS Co., Ltd.) as fluoride-containing compound was slowly dropped, further stirred for 30 minutes, and thereafter filtered under reduced pressure.

(6) The operation of the (1) was made twice, to obtain Filter Cake 1.

Then, Filter Cake 1 having been obtained was dried for 48 hours at 45° C. with a through-circulation dryer. Thereafter, it was sieved with a mesh of 75 μm, to prepare a toner base particle. This product was to be Toner Base Particle 1.

—External Additive Treatment—

Per 100 parts of Toner Base Particle 1, 0.7 parts of hydrophobic silica and 0.3 parts of hydrophobized titanium oxide were mixed and treated with Henschel mixer, to obtain Toner (1).

Manufacturing Example 2

Except that preparation of an oil phase of Manufacturing Example 1 is changed as follows, Toner (2) and Developer (2) were prepared as in Manufacturing Example 1.

—Preparation of Oil Phase—

Into a reaction vessel equipped with a stirring rod and a thermometer, 500 parts of Low Molecular Polyester 1 (manufactured by Sanyo Chemical Industries, Ltd., RS801)), 30 parts of carnauba wax, and 850 parts of ethyl acetate were fed, warmed to 80° C. under stirring, held for 5 hours as it is at 80° C., and thereafter cooled to 30° C. over 1 hour. Then, using a beads mill (Ultra-viscomill (manufactured by Imex Corp.), wax is dispersed on the conditions of solution feed velocity: 1 kg/hr, disk circumferential speed: 6 m/sec, 0.5 mm zirconia beads loading: 80% by volume, and pass number: 3 times. Subsequently, in the vessel, 110 parts of Bk Master Batch 1, 620 parts of inorganic fine particles (organo silica sol MEK-ST-UP(solid content concentration (ER)=20%), average primary particle size=15 nm,) manufactured by Nissan Chemical Industries, Ltd.), and 500 parts of ethyl acetate were put, and mixed for 1 hour, to prepare a dissolved product. This resulting product was to be Bk Raw Material Solution.

Then, 900 parts of Bk Raw Material Solution was transferred into the vessel, 50 parts of ethyl acetate and 165 parts of methyl-ethyl-ketone (MEK) were added, and using the above-the beads mill, a dispersion was obtained on the conditions of solution feed velocity: 0.8 kg/hr, disk circumferential speed: 12 m/sec, 0.5 mm zirconia beads loading: 80% by volume, and pass number: 3 times. This resulting product was to be Bk Oil Phase.

In this Comparative Example 1, in the stage of oil phase preparation of the manufacturing step, inorganic fine particles are put in a raw material oil phase at the same time as Master Batch 1. This Manufacturing Example 2 differs at this point from the Manufacturing Example 1 in which inorganic fine particles are put in with respect to a raw material solution in the final stage of oil phase preparation, that is in the state of Bk Pigment and Wax Dispersion.

Obtained toner of Manufacturing Example 2 was in the state in which silica resides uniformly in a toner base particle.

Manufacturing Example 3

Except that preparation of an oil phase of manufacturing example 1 is changed as follows, Toner (3) and Developer (3) were prepared as in Manufacturing Example 1.

—Preparation of Oil Phase—

Into a reaction vessel equipped with a stirring rod and a thermometer, 500 parts of Low Molecular Polyester 1 (polyester resin (manufactured by Sanyo Chemical Industries, Ltd., RS801)), 30 parts of carnauba wax, and 850 parts of ethyl acetate were fed, warmed to 80° C. under stirring, held for 5 hours as it is at 80° C., and thereafter cooled to 30° C. over 1 hour. Then, using a beads mill (Ultra-viscomill (manufactured by Imex Corp.), wax is dispersed on the conditions of solution feed velocity: 1 kg/hr, disk circumferential speed: 6 m/sec, 0.5 mm zirconia beads loading: 80% by volume, and pass number: 3 times. Subsequently, in the vessel, 110 parts of Bk Master Batch 1, and 500 parts of ethyl acetate were put, and mixed for 1 hour, to obtain a dissolved product. This product was to be Bk Raw Material Solution.

Then, 900 parts of obtained Bk Raw Material Solution was transferred into the vessel, 50 parts of ethyl acetate and 165 parts of methyl-ethyl-ketone (MEK) were added, and using the above-the beads mill, a dispersion was obtained on the conditions of solution feed velocity: 1 kg/hr, disk circumferential speed: 8 m/sec, 0.5 mm zirconia beads loading: 80% by volume, and pass number: 3 times. This resulting product was to be Bk Pigment and Wax Dispersion.

Then, to 100 parts of Bk Pigment and Wax Dispersion, 50 parts of inorganic fine particles (organo silica sol MEK-ST-UP (solid content concentration (ER)=20%), average primary particle size=15 nm, manufactured by Nissan Chemical Industries, Ltd.) was added, and mixed with TK homomixer. The resulting product having been obtained was to be Bk Oil Phase. The number of revolutions of a mixer is preferably in a range of 5,000 rpm to 12,000 rpm. A time period is preferably approximately 5 minutes to 20 minutes.

In this manufacturing example 3, at temperature of 25° C. at the time of mixing, the number of revolutions of the TK homomixer is 6,500 rpm, and a time period of rotation is 10 minutes.

Manufacturing Example 4

Except that preparation of an oil phase of manufacturing example 1 is changed as follows, Toner (4) and Developer (4) were prepared as in Manufacturing Example 1.

—Preparation of Oil Phase—

Into a reaction vessel equipped with a stirrer and a thermometer, 500 parts of Low Molecular Polyester 1 (polyester resin (manufactured by Sanyo Chemical Industries, Ltd., RS801)), 30 parts of carnauba wax, and 850 parts of ethyl acetate were fed, warmed to 80° C. under stirring, held for 5 hours as it is at 80° C., and thereafter cooled to 30° C. over 1 hour. Then, using a beads mill (Ultra-viscomill (manufactured by Imex Corp.), and wax is dispersed on the conditions of solution feed velocity: 1 kg/hr, disk circumferential speed: 6 m/sec, 0.5 mm zirconia beads loading: 80% by volume, and pass number: 3 times. Subsequently, in the vessel, 110 parts of Bk Master Batch 1, and 500 parts of ethyl acetate were put, and mixed for 1 hour, to obtain a dissolved product. This resulting product was to be Bk Raw Material Solution.

Then, 900 parts of Bk Raw Material Solution was transferred into the vessel, 50 parts of ethyl acetate and 165 parts of methyl-ethyl-ketone (MEK) were added, and using the above-the beads mill, a dispersion was obtained on the conditions of solution feed velocity: 1 kg/hr, disk circumferential speed: 8 m/sec, 0.5 mm zirconia beads loading: 80% by volume, and pass number: 3 times. This resulting product was to be Bk Pigment and Wax Dispersion.

To 100 parts of Bk Pigment and Wax Dispersion, 0 part of inorganic fine particles (organo silica sol MEK-ST-UP (solid content concentration (ER)=20%), average primary particle size=15 nm, manufactured by Nissan Chemical Industries, Ltd.) was added (not added), and mixed with TK homomixer. A product having been obtained was to be Bk Oil Phase. The number of revolutions of a mixer is preferably in a range of 5,000 rpm to 12,000 rpm. A time period is preferably approximately 5 minutes to 20 minutes.

In this Manufacturing Example 4, at temperature of 25° C. in mixing, the number of revolutions of the TK homomixer was 6,500 rpm, and a time period of rotation was 10 minutes.

In Manufacturing Examples 1 to 3, by changing the stage of feeding inorganic fine particles as the above-the conditions, the present state of inorganic fine particles in toner base particles is varied. Alternatively, methods of changing the present states of inorganic fine particles in toner base particles include e.g., alternation of preparation conditions or dispersion conditions of an oil phase. By the alternation of these conditions as appropriate, it is possible to adjust the present state of inorganic fine particles in toner base particles. As the alternation of dispersion conditions of an oil phase, in the case of large agitation rates, inorganic fine particles in toner base particles are finely dispersed, thereby approaching the uniform present state.

Owing to that these conditions are suitably combined, it is possible to achieve various present states of inorganic fine particles.

With each toner and each developer having been obtained, as described below, an abundance ratio, surface fluoride concentration, surface Si concentration of inorganic fine particles, shape factors SF-1 and SF-2 of toner, an average circularity of toner, as well as a volume average particle diameter and a particle size distribution of toner are measured. Results are shown with Table 1.

Furthermore, with each toner and each developer, as described below, a charge rise property, a charge stability with time, a cleaning property, and background smear were evaluated. Results are shown with Table 2.

<Determination of Inorganic Fine Particle Proportions $X_{surf}$ and $X_{total}$>

A toner base particle was dispersed in a saturated aqueous solution of 67% sucrose, frozen at −100° C., thereafter sliced in thickness of about 1,000 Angstrom with a cryomicrotome (EM-FCS, manufactured by Laica), and was photographed in a particle section at a magnification of 10,000 times with a transmission electron microscope (JEM-2010, JEOL Ltd.'s). Then, the area proportion $X_{surf}$ of inorganic fine particle shadows in the region of a part of 200 nm thickness in a vertical direction in an internal part of a particle from the surface of a toner particle, and the area proportion $X_{total}$ of inorganic fine particle shadows in the total region of a toner base particle sectional image, in a section which cross section is the maxi mum, were obtained using an image analyzer (nexus NEW CUBE ver. 2.5, manufactured by NEXUS). Moreover, this measurement was done with ten particles selected at random, and an average of respective values was taken as a measured value.

<Measurement of Surface Fluorine Concentration and Surface Si Concentration>

Using an X-ray photoelectron spectroscopic apparatus (1600S, manufactured by PHI), a silica element concentration and a fluorine element concentration on a toner base particle surface were measured. A toner base particle was put in an aluminum pan, and made to adhere to a specimen holder with a carbon sheet. Then, measurement was made with an X-ray source MgK. α-ray (400 W), and an analysis region 0.8×2.0 mm.

<Shape Factors SF-1 and SF-2>

Toner was photographed with a scanning electron microscope (S-800, manufactured by Hitachi, Ltd.), and this toner was introduced into an image analyzer (LUSEX3, manufactured by Nicore), and analyzed. Then, calculations were made using the following equations 1 and 2.

$$SF\text{-}1=(MXLNG)^2/AREA\times\Pi/4\times100 \quad \text{equation 1}$$

where MXLNG represents the maximum length across a two-dimensional projection of a toner particle, and AREA represents the area of the projection $$SF\text{-}2=(PERI)^2/AREA\times\tfrac{1}{4}\Pi\times100 \quad \text{equation 2}$$

where PERI represents the perimeter of a two-dimensional projection of a toner particle, and AREA represents the area of the projection <Average Circularity>

An average circularity can be measured with a flow-type particle image analyzer FPIA-2100 (manufactured by Toa Electronics Co., Ltd.). As a specific measurement method, 0.1 ml to 0.5 ml of a surfactant (alkylbenzene sulfonate) is added as a dispersant in 100 ml to 150 ml of water which impure solids have preliminarily been removed in a container, and further about 0.1 g to 0.5 g of a measurement sample is added. A suspension in which the sample has been dispersed is subjected to dispersion treatment for 1 minute to 3 minutes with an ultrasonic dispersing equipment. Then, with a dispersion concentration 3,000 numbers/μl to 10,000 numbers/μl, an average circularity is obtained by measuring the shapes and distributions of toner with the equipment.

<Particle Diameter and Particle Size Distribution of Toner>

The volume average particle diameter (Dv) and number average particle diameter (Dn) of a toner base particle were measured using a particle size analyzer ("Multi-Sizer", manufactured by Beckman Coulter Electronics, Inc.,) with an aperture diameter 100 μm.

<Measurement of Charge Density>

At room temperature, 7 parts of toner and 93 parts of magnetic carrier (volume average particle diameter 35 μm, manufactured by Ricoh Co.) were put in a dedicated gage, and stirred at 280 rpm with a dedicated agitator. The charge density was measured by blow-off method. Stirring time periods of the gage were 15 seconds, 600 seconds, and 1,800 seconds. The charge densities were TA15(-μC/g), TA600(-μC/g), and TA1800(-μC/g) (numerals after TA stand for stirring time periods (second) of carrier and toner).

<Charge Rise Property>

In measurement of the charge density, the case in which values of TA 15 are 26 or more was evaluated to be A, the case of 22 to 25 was evaluated to be B , the case of 18 to 21 was evaluated to be C, and the case of 17 or less was evaluated to be D.

Furthermore, as to charge stabilities with time, the case in which "TA 1800 minus TA 600" is 2 or less was evaluated to be A, the case of 3 to 4 was evaluated to be B, the case of 5 to 8 was evaluated to be C, and the case of 9 or more was evaluated to be D.

<Cleaning Property>

Using an image forming apparatus (IPSIO 8000, manufactured by Ricoh Co.), a residual transfer toner on a photoconductor through the cleaning step after 100 sheets of papers have been outputted was transferred to a blank paper with Scotch Tape (manufactured by Sumitomo 3M co., Ltd.), measured with Macbeth reflection densitometer RD 514-type, and evaluated on the below-the criteria.

<Evaluation Criteria>

A: A difference from a blank is less than 0.005.

B : A difference from a blank is 0.005 to 0.010.

C: A difference from a blank is 0.011 to 0.02.

D : A difference form a blank exceeds 0.02.

<Background Smear>

Using an image forming apparatus (IPSIO 8000, manufactured by Ricoh Co.), 30,000 sheets of image charts of 50% image area was running-outputted in a single-color mode, thereafter a white image was stopped during development, a developer on a photoconductor after development was transferred to a tape, and the difference of image densities between this tape and a blank tape was measured with 938 spectrodensitometer (manufactured by X-Rite). As the difference between image densities is decreased, less background smear occurs. Ranks becomes higher in order of D, C, B, A.

TABLE 1

| | Xsurf | Xtotal | SF-1 | SF-2 | fluorine atom | Si atom | average circularity | Dv (μm) | Dv/Dn |
|---|---|---|---|---|---|---|---|---|---|
| toner 1 | 89% | 40% | 130 | 135 | 3.6 atomic % | 5.7 atomic % | 0.94 | 5.6 | 1.21 |
| toner 2 | 35% | 42% | 128 | 130 | 1.2 atomic % | 0.9 atomic % | 0.96 | 5.2 | 1.18 |
| toner 3 | 72% | 55% | 132 | 136 | 3.2 atomic % | 11.2 atomic % | 0.93 | 6.2 | 1.25 |
| toner 4 | 0% | 0% | 127 | 120 | 1.5 atomic % | 0 atomic % | 0.98 | 5.5 | 1.14 |

TABLE 2

| | TA15 (⁻μc/g) | TA600 (⁻μc/g) | TA1800 (⁻μc/g) | charge rise property | charge stability with time | cleaning property | background smear |
|---|---|---|---|---|---|---|---|
| toner 1 | 29 | 31 | 32 | A | A | A | A |
| toner 2 | 17 | 26 | 19 | D | C | A | D |
| toner 3 | 32 | 35 | 33 | A | A | A | A |
| toner 4 | 16 | 24 | 18 | D | C | D | D |

Examples 1 to 4 and Comparative Examples 1 to 4

By the combination of toners and fixing units shown in the following Table 3, as shown below, fixities were evaluated, and overall evaluations were made. Results are shown with Table 3.

<Fixing Property>

—Fixing Lower Limit Temperature>

Using an image forming apparatus (IPSIO 8000, manufactured by Ricoh Co.) provided with fixing units shown in FIG. 1 (fixing unit A), or FIGS. 2, 3A, and 3B (fixing unit B), adjustment was made so that toner of 1.0±0.05 mg/cm$^2$ is developed in a solid image onto transfer papers of a plain paper and a cardboard (type 6200, manufactured by Ricoh Co. Ltd. and a reproduction printing paper<135>manufactured by NBS Ricoh Co.), and adjustment of making temperatures of a fixing belts variable was made. Further, temperatures at which no offset occurs were measured with a plain paper, and fixing lower limit temperatures were measured with a cardboard. As to a fixing lower limit temperature, a fixing belt temperature at which a residual rate of image densities more than 70% after an obtained fixed image is rubbed with a pat is to be a fixing lower limit temperature.

<Evaluation Criteria>

A: A fixing lower limit temperature is less than 135° C.

B : A fixing lower limit temperature is 135° C. or more and less than 145° C.

C : A fixing lower limit temperature is 145° C. or more and less than 155° C.

D: A fixing lower limit temperature is 155° C. or more.

<Offset Occurrence Temperature>

A fixing evaluation was made as in the above-the fixing lower limit temperature, and the presence or absence of hot offset with respect to a fixed image was visually evaluated. A fixing roll temperature at which hot offset occurs was to be a hot offset occurrence temperature.

[Evaluation Criteria]

A: A hot offset occurrence temperature is 190° C. or more.

B: A hot offset occurrence temperature is 180° C. or more and less than 190° C.

C: A hot offset occurrence temperature is 170° C. or more and less than 180° C.

D: An hot offset occurrence temperature is less than 170° C.

<Overall Evaluations>

A: excellent

B: practically usable level

C: practically unusable level

TABLE 3

| | toner | fixing unit | fixity: fixing lower limit temperature | fixity: hot offset occurrence temperature | overall evaluation |
|---|---|---|---|---|---|
| Example 1 | toner 1 | A | C | B | B |
| Example 2 | toner 1 | B | B | A | A |
| Comparative Example 1 | toner 2 | A | D | C | C |
| Comparative Example 2 | toner 2 | B | D | B | C |
| Example 3 | toner 3 | A | D | A | B |
| Example 4 | toner 3 | B | C | A | B |
| Comparative Example 3 | toner 4 | A | B | D | C |
| Comparative Example 4 | toner 4 | B | A | C | B |

In toner used in an image forming method according to the present invention, inorganic fine particles are put in the final stage of an oil phase preparation step, and the number of revolutions and the time period of revolutions of a mixer when these components are mixed are to be in the above-described range, thereby controlling dispersion states. Whereby, inorganic fine particles are uniformly localized in the vicinity of a toner particle surface, and further it is possible to suppress the occurrence of fluctuations in a fine particle content between toner particles Like this, when inorganic fine particles are added at the same time as a resin material, a colorant and the like, and uniformly mixed, the dispersion of pigments and the dispersion of inorganic fine particles cannot be individually controlled, and thus deformation comes hard to be controlled. Furthermore, in case of too high dispersion conditions, fine particles will be finely dispersed in an oil phase, and thus no deformation will go on as appropriate.

Moreover, as described above, as another method of changing the present state in a toner core of inorganic fine particles, there is e.g., the change of preparation conditions or dispersion conditions of an oil phase. By suitably changing these conditions, the present state of inorganic fine particles in a toner base particle can be adjusted. As seen with results of table 2, since Toner 1 of Manufacturing Example 1 is formed at the surface to be concavo-convex shaped well, a superior cleaning property is achieved. Further, since Toner 1 of Manufacturing Example 1 has a high charge density, a superior charge rise property (shown with TA15), and a stable charge density with time, a good result of no background smear was obtained. For fixing property, a low-temperature fixing property of a fixing unit A shown in FIG. 1 was poor, and a low-temperature fixing property with a fixing unit B shown in FIGS. 2, 3A and 3B obtained good results.

Whereas, in Toner 2 of Manufacturing Example 2, deformation is insufficient, and thus less cleaning property was shown. Moreover, in Toner 2 of Manufacturing Example 2, as compared with Toner 1 of Manufacturing Example 1, the density was low, a charge rise property and stability with time of charge density were poor, and background smear was recognized under environments at low temperature and at low humidity. In addition, as to fixing property, with both a fixing unit A shown in FIG. 1 and a fixing unit B shown in FIGS. 2, 3A and 3B, results of poor low-temperature fixing property were obtained.

What is claimed is:

1. An image forming method comprising:

forming a latent electrostatic image on a latent electrostatic image bearing member;

developing the latent electrostatic image using a toner to form a visible image;

transferring the visible image to a recording medium; and fixing a transfer image transferred on the recording medium, wherein the toner comprises a toner base particle containing at least a binder resin, a colorant and inorganic fine particles, and a charge control agent, and wherein the condition $X_{surf}>X_{total}$ is satisfied (where $X_{surf}$ represents an average proportion of the inorganic fine particles present in a near-surface region of the toner base particle, and $X_{total}$ represents an average proportion of the inorganic fine particles present in the whole toner base particle), wherein the average proportion $X_{surf}$ is an average proportion of the inorganic fine particles present in the toner base particle in a region within 200 nm from the surface thereof.

2. The image forming method according to claim 1, wherein the fixing is conducted using a fixing unit, wherein the fixing unit comprises:

a heating roller which is made of a magnetic metal and is heated by electromagnetic induction;

a fixing roller disposed in parallel to the heating roller;

a toner heating medium formed of an endless strip which is stretched between the heating roller and the fixing roller and which is heated by the heating roller and rotated by the heating roller and the fixing roller; and a pressure roller which is pressed against the fixing roller through the toner heating medium and which is rotated in a direction in which the toner heating medium moves to thereby form a nip portion.

3. The image forming method according to claim 1, wherein a part of the inorganic fine particle is exposed at the toner surface.

4. The image forming method according to claim 1, wherein the inorganic fine particles are made of silica.

5. The image forming method according to claim 4, wherein the silica is an organosol synthesized with wet a method.

6. The image forming method according to claim 4, wherein the content of silicon atoms which are derived from silica and present on the toner base particle surface is 0.5 atomic % by number to 10 atomic % by number, as determined with an X-ray electron spectroscopy (XPS).

7. The image forming method according to claim 1, wherein the average primary particle diameter of the inorganic fine particles is 100 nm or less.

8. The image forming method according to claim 1, wherein the charge control agent is externally added with a wet method.

9. The image forming method according to claim 1, wherein the charge control agent is a fluorine-containing compound.

10. The image forming method according to claim 9, wherein the content of fluorine atoms which are derived from the fluorine-containing compound and present on the toner surface is 2.0 atomic % by number to 15 atomic % by number, as determined with an X-ray electron spectroscopy (XPS).

11. The image forming method according to claim 1, wherein the average circularity of toner is 0.94 to 0.97.

12. The image forming method according to claim 1, wherein a shape factor SF-1 represented by the following equation 1 is 110 to 140, and a shape factor SF-2 represented by the following equation 2 is 120 to 160

$$\text{SF-1}=(MXLNG)^2/\text{AREA}\times\Pi/4\times100 \qquad \text{equation 1}$$

where MXLNG represents the maximum length across a two-dimensional projection of a toner particle, and AREA represents the area of the projection $$\text{SF-2}=(PERI)^2/\text{AREA}\times\tfrac{1}{4}\Pi\times100 \qquad \text{equation 2}$$

where PERI represents the perimeter of a two-dimensional projection of a toner particle, and AREA represents the area of the projection.

13. The image forming method according to claim 1, wherein the volume average particle diameter of toner (Dv) is 3 μm to 8 μm, and the ratio of the volume average particle diameter (Dv) to the number average particle diameter (Dn), Dv/Dn is 1.00 to 1.40.

14. The image forming method according to claim 1, wherein toner is obtained by dissolving or dispersing in an organic solvent a toner material containing an active hydrogen group-containing compound, and a polymer capable of being reacted with the active hydrogen group-containing compound to prepare a toner solution, emulsifying or dispersing the toner solution in an aqueous medium to prepare a dispersion, causing the active hydrogen group-containing compound and a polymer capable of being reacted with the active hydrogen group-containing compound to react to generate an adhesive base material in particles, and removing the organic solvent.

15. The image forming method according to claim 1, wherein toner is a two component developer containing a carrier.

* * * * *